US011306274B2

(12) United States Patent
Saito et al.

(10) Patent No.: US 11,306,274 B2
(45) Date of Patent: Apr. 19, 2022

(54) LIQUID DETERGENT COMPOSITION FOR HARD SURFACES

(71) Applicant: Kao Corporation, Tokyo (JP)

(72) Inventors: Shinya Saito, Wakayama (JP); Keigo Suzuki, Wakayama (JP); Takuji Kawamura, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 16/613,098

(22) PCT Filed: Jun. 20, 2018

(86) PCT No.: PCT/JP2018/023376
§ 371 (c)(1),
(2) Date: Nov. 12, 2019

(87) PCT Pub. No.: WO2019/004014
PCT Pub. Date: Jan. 3, 2019

(65) Prior Publication Data

US 2020/0095520 A1 Mar. 26, 2020

(30) Foreign Application Priority Data

Jun. 26, 2017 (JP) ..... JP2017-124418
Jun. 26, 2017 (JP) ..... JP2017-124419

(51) Int. Cl.

| | |
|---|---|
| ***C11D 1/75*** | (2006.01) |
| ***C11D 1/40*** | (2006.01) |
| ***C11D 11/00*** | (2006.01) |
| ***C11D 17/08*** | (2006.01) |

(52) U.S. Cl.
CPC ..... *C11D 1/75* (2013.01); *C11D 1/40* (2013.01); *C11D 11/0041* (2013.01); *C11D 17/08* (2013.01)

(58) Field of Classification Search
CPC ..... C11D 3/48; C11D 11/0023; C11D 17/049; C11D 1/75
See application file for complete search history.

(56) References Cited

U.S. PATENT DOCUMENTS

| | | | | |
|---|---|---|---|---|
| 5,252,245 | A * | 10/1993 | Garabedian, Jr. ..... | C11D 3/323 510/427 |
| 2014/0148372 | A1* | 5/2014 | Man ..... | C11D 1/146 510/407 |
| 2014/0158166 | A1* | 6/2014 | Saraf ..... | C11D 1/94 134/22.19 |

FOREIGN PATENT DOCUMENTS

| | | | |
|---|---|---|---|
| CN | 1076476 | A | 9/1993 |
| CN | 1167800 | A | 12/1997 |
| CN | 106635496 | A | 5/2017 |
| JP | 2002-371299 | A | 12/2002 |
| JP | 2003-119496 | A | 4/2003 |
| JP | 2011-236379 | * | 11/2011 |
| JP | 2011-236397 | A | 11/2011 |
| JP | 2012-126883 | A | 7/2012 |
| JP | 2014-74125 | A | 4/2014 |
| JP | 2015-166409 | A | 9/2015 |
| JP | 2016-30826 | A | 3/2016 |
| JP | 2017-119763 | A | 7/2017 |
| SG | 190808 | A1 | 7/2013 |
| WO | WO 96/12000 | A | 4/1996 |

OTHER PUBLICATIONS

Chinese Office Action and Search Report, dated Sep. 15, 2020, for Chinese Application No. 201880024997.0.
International Search Report for PCT/JP2018/023376 (PCT/ISA/210) dated Jul. 31, 2018.
Product Information, pp. 1-2, http://chemical.kao.com/jp/pdf/catalog/catalog_B0001615.pdf, Chemical Business Unit, Kao Corporation, 2-1-3, Bunka, Sumida-ku, Tokyo, 131-8501, Ethylene Oxide-added Fatty Amine "AMIET" Aug. 2011.
International Preliminary Report on Patentability and English translation of the Written Opinion of the International Searching Authority for International Application No. PCT/JP2018/023376, dated Jan. 9, 2020.

* cited by examiner

*Primary Examiner* — John R Hardee
(74) *Attorney, Agent, or Firm* — Birch, Stewart, Kolasch & Birch, LLP

(57) ABSTRACT

Provided are a liquid detergent composition for hard surfaces which is excellent in detergency against oil spots including a degenerated oil such as a thermally degenerated oil; and a method for cleaning a hard surface using the liquid detergent composition. The liquid detergent composition for hard surfaces contains (a) an alkyl or alkenyl amine oxide in which the alkyl group or the alkenyl group has a predetermined number of carbons; a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of (b) a monooxyethylene or polyoxyethylene alkyl or alkenyl amine in which the alkyl group or the alkenyl group has a predetermined number of carbons and the number of added moles of the oxyethylene group is 1 or more and 3 or less is 50% by mass or more.

11 Claims, No Drawings

LIQUID DETERGENT COMPOSITION FOR HARD SURFACES

FIELD OF THE INVENTION

The present invention relates to a liquid detergent composition for hard surfaces, and a method for cleaning a hard surface.

BACKGROUND OF THE INVENTION

As kitchen detergents for articles in and around kitchens such as ranges, ovens, walls and floors around ranges, and ventilation fans, and detergents for food processing installations, detergents containing a surfactant, a solvent, an alkali agent and the like are generally used for removing oil spots degenerated under the action of heat, sunlight, oxygen in air or the like.

As a detergent composition for hard surfaces which has excellent detergency against cooking oil spots, for example, JP-A 2012-126883 discloses a liquid detergent composition for hard surfaces which contains (a) a polyalkylene glycol monoalkyl ether, (b) an amine oxide, (c) one or more kinds selected from the group consisting of a fatty acid having 8 to 18 carbons and a salt thereof, and water.

In addition, as a detergent composition excellent in cleaning properties, foaming properties and oil separation properties, JP-A 2003-119496 discloses a detergent composition containing (A) at least one kind selected from the group consisting of a polyoxyethylene adduct or a polyoxyethylene polyoxypropylene adduct of a monoalkyl amine or an N-alkyl propylenediamine having a linear or branched chain with 8 to 22 carbons, and a polyoxyethylene adduct of a monoalkyl amide having a linear or branched chain with 8 to 22 carbons, and (B) at least one selected from the group consisting of an alkyl dimethylamine oxide having a linear or branched chain with 8 to 22 carbons, an alkyl di(aminomethyl)glycine having a linear or branched chain with 6 to 22 carbons, linear sodium dodecylbenzenesulfonate and lauryldimethylaminoacetic acid betaine.

SUMMARY OF THE INVENTION

As kitchen detergents and detergents for food processing installations, detergents capable of removing oil spots including a degenerated oil, particularly oil spots including a thermally degenerated oil are desired.

The present invention relates to a liquid detergent composition for hard surfaces which is excellent in detergency against oil spots including a degenerated oil such as a thermally degenerated oil (hereinafter also referred to simply as detergency); and a method for cleaning a hard surface using the liquid detergent composition for hard surfaces.

In the specification of the present application, the degenerated oil is an oil including oil components degenerated under the action of heat, sunlight, oxygen in air or the like. The thermally degenerated oil is an oil degenerated by heat, and includes oil components oxidized by heat.

The present invention relates to a liquid detergent composition for hard surfaces which contains (a1) an alkyl or alkenyl amine oxide in which the alkyl group or the alkenyl group has 8 or more and 12 or less carbons (hereinafter referred to as component (a1)); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of (b1) a monooxyethylene or polyoxyethylene alkyl or alkenyl amine in which the alkyl group or the alkenyl group has 16 or more and 24 or less carbons and the number of added moles of the oxyethylene group is 1 or more and 3 or less (hereinafter referred to as component (b1)) is 50% by mass or more. Hereinafter, the liquid detergent composition for hard surfaces is referred to as a first aspect of the present invention.

The present invention also relates to a liquid detergent composition for hard surfaces which is obtained by formulating (A1) an alkyl or alkenyl amine oxide in which the alkyl group or the alkenyl group has 8 or more and 12 or less carbons (hereinafter referred to as component (A1)); (B1) a monooxyethylene or polyoxyethylene alkyl or alkenyl amine in which the alkyl group or the alkenyl group has 16 or more and 24 or less carbons and the average number of added moles of the oxyethylene group is 1 or more and 3 or less (hereinafter referred to as component (B1)); and water. Hereinafter, the liquid detergent composition for hard surfaces is referred to as a second aspect of the present invention.

The present invention also relates to a liquid detergent composition for hard surfaces which contains (a2) an alkyl or alkenyl amine oxide in which the alkyl group or the alkenyl group has 14 or more and 18 or less carbons (hereinafter referred to as component (a2)); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of (b2) a monooxyethylene or polyoxyethylene alkyl or alkenyl amine in which the alkyl group or the alkenyl group has 8 or more and 14 or less carbons and the number of added moles of the oxyethylene group is 1 or more and 3 or less (hereinafter referred to as component (b2)) is 50% by mass or more. Hereinafter, the liquid detergent composition for hard surfaces is referred to as a third aspect of the present invention.

The present invention also relates to a liquid detergent composition for hard surfaces which is obtained by formulating (A2) an alkyl or alkenyl amine oxide in which the alkyl group or the alkenyl group has 14 or more and 18 or less carbons (hereinafter referred to as component (A2)); (B2) a monooxyethylene or polyoxyethylene alkyl or alkenyl amine in which the alkyl group or the alkenyl group has 8 or more and 14 or less carbons and the average number of added moles of the oxyethylene group is 1 or more and 3 or less (hereinafter referred to as component (B2)); and water. Hereinafter, the liquid detergent composition for hard surfaces is referred to as a fourth aspect of the present invention.

The present invention also relates to a method for cleaning a hard surface in which oil spots adhered to a hard surface and including a degenerated oil are removed with the liquid detergent composition for hard surfaces.

The present invention provides a liquid detergent composition for hard surfaces which is excellent in detergency against oil spots including a degenerated oil such as a thermally degenerated oil; and a method for cleaning a hard surface in which oil spots adhered to a hard surface and including a degenerated oil such as a thermally degenerated oil are removed with the liquid detergent composition for hard surfaces.

EMBODIMENTS OF THE INVENTION

<Liquid Detergent Composition for Hard Surfaces>

A thermally degenerated oil has high viscosity because it is considered to include oil components with oil components partially changed to polar groups by oxidation of an oil by heat, dimerized or trimerized oil components, or high-molecular-weight oil components subjected to sequentially proceeding oxidation reaction. Removal of such a thermally degenerated oil having high viscosity is considered to require that a surfactant infiltrate the thermally degenerated oil, and emulsify or solubilize the oil.

Although the reason why the liquid detergent composition for hard surfaces according to the present invention is excellent in detergency against oil spots including a degenerated oil, particularly a thermally degenerated oil, is not necessarily evident, it is presumed that by using either one of a combination of component (a1) and component (b1) and a combination of component (a2) and component (b2) in the present invention, infiltration of a surfactant into a thermally degenerated oil can be facilitated to effectively perform emulsification or the like of the thermally degenerated oil, and thus a high detergent effect is obtained.

<First Aspect>

The first aspect of the present invention is a liquid detergent composition for hard surfaces which contains component (a1); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of component (b1) is 50% by mass or more.

<Component (a1)>

Component (a1) in the present invention is an alkyl or alkenyl amine oxide in which the alkyl group or the alkenyl group has 8 or more and 12 or less carbons.

From the viewpoint of detergency, component (a1) is preferably an amine oxide having an alkyl group with 10 or more and 12 or less carbons, more preferably an amine oxide having an alkyl group with 12 carbons.

From the viewpoint of detergency, component (a1) is suitably a compound represented by general formula (a11) below:

[Formula 1]

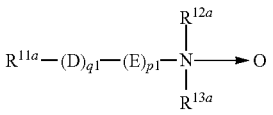

(a11)

wherein $R^{11a}$ represents an alkyl group having 8 or more and 12 or less carbons or an alkenyl group having 8 or more and 12 or less carbons, preferably an alkyl group having 8 or more and 12 or less carbons, $R^{12a}$ and $R^{13a}$ each independently represent an alkyl group having 1 or more and 3 or less carbons; D represents a —NHC(=O)— group or a —C(=O)NH— group, and E represents an alkylene group having 1 or more and 5 or less carbons; and q1 and p1 represent that q1=0 and p1=0 or q1=1 and p1=1.

From the viewpoint of detergency, $R^{11a}$ in general formula (a11) above is preferably an alkyl group having 10 or more and 12 or less carbons, more preferably an alkyl group having 12 carbons. From the viewpoint of detergency, each of $R^{12a}$ and $R^{13a}$ is preferably a methyl group having 1 carbon. From the viewpoint of detergency, q1 and p1 are preferably q1=0 and p1=0.

Preferred specific examples of component (a1) include (1) alkyl (8 or more and 12 or less carbons) dialkyl (1 or more and 3 or less carbons) amine oxides such as capryl dimethylamine oxide, caprin dimethylamine oxide and lauryl dimethylamine oxide; and (2) fatty acid (8 or more and 12 or less carbons) amidopropyl dialkyl (1 or more and 3 or less carbons) amine oxides such as lauric acid amidopropyl dimethylamine oxide, and from the viewpoint of detergency, (1) alkyl (8 or more and 12 or less carbons) dialkyl (1 or more and 3 or less carbons) amine oxides are more preferable.

The liquid detergent composition for hard surfaces according to the present invention contains component (a1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more from the viewpoint of detergency, and preferably 20% by mass or less, more preferably 10% by mass or less, further preferably 8% by mass or less, furthermore preferably 6% by mass or less, furthermore preferably 5% by mass or less, furthermore preferably 4% by mass or less from the viewpoint of economic efficiency.

The liquid detergent composition for hard surfaces according to the present invention may contain amine oxides other than component (a1) within a range that does not impair the effects of the present invention.

From the viewpoint of detergency, the content of component (a1) is preferably 50% by mass or more, more preferably 70% by mass or more, further preferably 80% by mass or more, furthermore preferably 90% by mass or more, and preferably 100% by mass or less, more preferably 100% by mass in the alkyl or alkenyl amine oxide in which the alkyl group or the alkenyl group has 8 or more and 18 or less carbons in the liquid detergent composition for hard surfaces according to the present invention. Here, the alkyl or alkenyl amine oxide in which the alkyl group or the alkenyl group has 8 or more and 18 or less carbons preferably has the same structure except that $R^{11a}$ is an alkyl group or an alkenyl group having 8 or more and 18 or less carbons in general formula (a11) above.

<Component (b1)>

Component (b1) in the present invention is a monooxyethylene or polyoxyethylene alkyl or alkenyl amine in which the alkyl group or the alkenyl group has 16 or more and 24 or less carbons and the number of added moles of the oxyethylene group is 1 or more and 3 or less.

From the viewpoint of detergency, the number of carbons in the alkyl group or the alkenyl group in component (b1) is preferably 22 or less, more preferably 20 or less, further preferably 18 or less, and among these groups, the alkyl group is preferable.

Examples of the alkyl group having 16 or more and 24 or less carbons or the alkenyl group having 16 or more and 24 or less carbons include a hexadecyl group, a heptadecyl group and an octadecyl group, and these groups may be n-groups or iso-groups, and may be secondary alkyl groups or secondary alkenyl groups. Here, the secondary alkyl group or the secondary alkenyl group is an alkyl group or an alkenyl group in which the carbon atom bonded to the nitrogen atom of the amine is a tertiary carbon atom.

In component (b1), the number of added moles of the oxyethylene group is preferably 2 or more and 3 or less from the viewpoint of detergency.

In addition, an oxypropylene group may be added to component (b1) within a range that does not impair the effects of the present invention. For example, in component (b1), the number of added moles of the oxypropylene group is preferably 0.5 or less and preferably 0 or more; and it is preferably 0.

From the viewpoint of detergency, component (b1) is suitably a compound represented by general formula (b11) below:

[Formula 2]

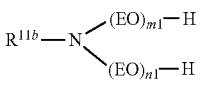

(b11)

wherein $R^{11b}$ is an alkyl group having 16 or more and 24 or less carbons or an alkenyl group having 16 or more and 24 or less carbons, EO is an oxyethylene group, each of m1 and n1 is the number of added moles, and independently a number of 0 or more and 3 or less, and m1+n1 is a number of 1 or more and 3 or less.

From the viewpoint of detergency, the number of carbons in $R^{11b}$ in general formula (b11) above is 16 or more and 24 or less, preferably 20 or less, more preferably 18 or less. From the viewpoint of detergency, $R^{11b}$ is an alkyl group or an alkenyl group, preferably an alkyl group. From the viewpoint of detergency, m1 and n1 are preferably numbers meeting the requirement that m1+n1 be a number of 2 or more and 3 or less.

The liquid detergent composition for hard surfaces according to the present invention contains component (b1) in an amount of preferably 0.01% by mass or more, more preferably 0.05% by mass or more, further preferably 0.1% by mass or more, furthermore preferably 0.2% by mass or more, furthermore preferably 0.3% by mass or more and furthermore preferably 0.5% by mass or more; and from the viewpoint of economic efficiency, preferably 20% by mass or less, more preferably 10% by mass or less, further preferably 8% by mass or less, furthermore preferably 6% by mass or less, furthermore preferably 5% by mass or less and furthermore preferably 4% by mass or less.

The liquid detergent composition for hard surfaces according to the present invention may contain polyoxyethylene alkyl or alkenyl amines other than component (b1) within a range that does not impair the effects of the present invention.

From the viewpoint of detergency, the content of component (b1) is 50% by mass or more, preferably 60% by mass or more, more preferably 70% by mass or more, further preferably 80% by mass or more, furthermore preferably 90% by mass or more, and preferably 100% by mass or less in the monooxyethylene or polyoxyethylene alkyl or alkenyl amine in which the alkyl group or the alkenyl group has 8 or more and 24 or less carbons and the number of added moles of the oxyethylene group is 1 or more and 8 or less in the liquid detergent composition for hard surfaces according to the present invention.

From the viewpoint of detergency, the content of the monooxyethylene or polyoxyethylene alkyl or alkenyl amine in which the alkyl group or the alkenyl group has 16 or more and 18 or less carbons and the number of added moles of the oxyethylene group is 1 or more and 3 or less is preferably 50% by mass or more, more preferably 60% by mass or more, further preferably 70% by mass or more, furthermore preferably 80% by mass or more, furthermore preferably 90% by mass or more, and preferably 100% by mass or less in component (b1) in the liquid detergent composition for hard surfaces according to the present invention.

From the viewpoint of detergency, the content of the monooxyethylene or polyoxyethylene alkyl or alkenyl amine in which the alkyl group or the alkenyl group has 16 or more and 18 or less carbons and the number of added moles of the oxyethylene group is 1 or more and 3 or less is preferably 50% by mass or more, more preferably 60% by mass or more, further preferably 70% by mass or more, furthermore preferably 80% by mass or more, furthermore preferably 90% or more, and preferably 100% by mass or less in the monooxyethylene or polyoxyethylene alkyl or alkenyl amine in which the alkyl group or the alkenyl group has 8 or more and 24 or less carbons and the number of added moles of the oxyethylene group is 1 or more and 8 or less in the liquid detergent composition for hard surfaces according to the present invention.

In the liquid detergent composition for hard surfaces according to the present invention, the mass ratio of the content of component (a1) to the content of component (b1), (a1)/(b1), is preferably 0.1 or more, more preferably 0.2 or more, further preferably 0.3 or more from the viewpoint of detergency, and preferably 20 or less, more preferably 15 or less, further preferably 12 or less, furthermore preferably 10 or less, furthermore preferably 8 or less, furthermore preferably 7 or less from the same viewpoint.

In the liquid detergent composition for hard surfaces according to the present invention, the total content of the content of component (a1) and the content of component (b1) is preferably 0.02% by mass or more, more preferably 0.1% by mass or more, further preferably 0.5% by mass or more, furthermore preferably 1% by mass or more, furthermore preferably 1.5% by mass or more, furthermore preferably 2.5% by mass or more from the viewpoint of detergency, and preferably 40% by mass or less, more preferably 30% by mass or less, further preferably 20% by mass or less, furthermore preferably 10% by mass or less from the viewpoint of economic efficiency.

From the viewpoint of detergency, the total content of the content of component (a1) and the content of component (b1) is preferably 50% by mass or more, more preferably 60% by mass or more, further preferably 80% by mass or more, furthermore preferably 90% by mass or more, and preferably 100% by mass or less in all surfactants in the liquid detergent composition for hard surfaces according to the present invention.

<Second Aspect>

The second aspect of the present invention is a liquid detergent composition for hard surfaces which is obtained by formulating component (A1), component (B1) and water.

From the viewpoint of detergency, the liquid detergent composition for hard surfaces according to the present invention is preferably obtained by formulating component (A1), component (B1) and water.

By the formulation described above, the liquid detergent composition for hard surfaces according to the first aspect, which contains component (a1), component (b1) and water, can be obtained.

<Component (A1)>

Component (A1) in the present invention is identical to component (a1) in the present invention. It is possible to use component (A1) in the present invention which has the aspect described for component (a1) in the present invention.

In the liquid detergent composition for hard surfaces according to the present invention, component (A1) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more from the viewpoint of detergency, and preferably 20% by mass or less, more preferably 10% by mass or less, further preferably 8% by mass or less, furthermore preferably 6% by mass or less, furthermore preferably 5% by mass or less, furthermore preferably 4% by mass or less from the viewpoint of economic efficiency.

<Component (B1)>

Component (B1) in the present invention is a monooxyethylene or polyoxyethylene alkyl or alkenyl amine in which the alkyl group or the alkenyl group has 16 or more and 24 or less carbons and the average number of added moles of the oxyethylene group is 1 or more and 3 or less. Component (B1) may contain component (b1). The liquid detergent composition for hard surfaces according to the present invention, which contains component (b1), may be obtained by formulating component (B1).

From the viewpoint of detergency, the number of carbons in the alkyl group or the alkenyl group in component (B1) is preferably 22 or less, more preferably 20 or less, further preferably 18 or less, and among these groups, an alkyl group is preferable.

Examples of the alkyl group having 16 or more and 24 or less carbons or the alkenyl group having 16 or more and 24 or less carbons include a hexadecyl group, a heptadecyl group and an octadecyl group, and these groups may be n-groups or iso-groups, and may be secondary alkyl groups or secondary alkenyl groups.

In component (B1), the average number of added moles of the oxyethylene group is preferably a number of 1.5 or more and 2.5 or less from the viewpoint of detergency.

In addition, an oxypropylene group may be added to component (B1) within a range that does not impair the effects of the present invention. For example, in component (B1), the average number of added moles of the oxypropylene group is preferably 0.5 or less, and preferably 0 or more, more preferably 0.

From the viewpoint of detergency, component (B1) is suitably a compound represented by general formula (b12) below:

[Formula 3]

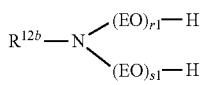

(b12)

wherein $R^{12b}$ is an alkyl group or an alkenyl group having 16 or more and 24 or less carbons, EO is an oxyethylene group, each of r1 and s1 is the average number of added moles, and r1+s1 is a number of 1 or more and 3 or less.

From the viewpoint of detergency, the number of carbons in $R^{12b}$ in general formula (b12) above is 16 or more, and 22 or less, preferably 20 or less, more preferably 18 or less. From the viewpoint of detergency, $R^{12b}$ is an alkyl group or an alkenyl group, preferably an alkyl group. From the viewpoint of detergency, r1 and s1 are preferably numbers meeting the requirement that r1+s1 be a number of 1.5 or more and 2.5 or less.

In the liquid detergent composition for hard surfaces according to the present invention, component (B1) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more and furthermore preferably 0.8% by mass or more; and from the viewpoint of economic efficiency, preferably 20% by mass or less, more preferably 10% by mass or less, further preferably 8% by mass or less, furthermore preferably 6% by mass or less, furthermore preferably 5% by mass or less and furthermore preferably 4% by mass or less.

In the liquid detergent composition for hard surfaces according to the present invention, the mass ratio of the formulation amount of component (A1) to the formulation amount of component (B1), (A1)/(B1), is preferably 0.1 or more, more preferably 0.2 or more, further preferably 0.3 or more from the viewpoint of detergency, and preferably 20 or less, more preferably 15 or less, further preferably 12 or less, furthermore preferably 10 or less, furthermore preferably 8 or less, furthermore preferably 7 or less from the same viewpoint.

In the liquid detergent composition for hard surfaces according to the present invention, the total formulation amount of the formulation amount of component (A1) and the formulation amount of component (B1) is preferably 0.02% by mass or more, more preferably 0.1% by mass or more, further preferably 0.5% by mass or more, furthermore preferably 1% by mass or more, furthermore preferably 1.5% by mass or more, furthermore preferably 2.5% by mass or more from the viewpoint of detergency, and preferably 40% by mass or less, more preferably 30% by mass or less, further preferably 20% by mass or less, furthermore preferably 10% by mass or less from the viewpoint of economic efficiency.

From the viewpoint of detergency, the total formulation amount of the formulation amount of component (A1) and the formulation amount of component (B1) is preferably 50% by mass or more, more preferably 60% by mass or more, further preferably 80% by mass or more, furthermore preferably 90% by mass or more, and preferably 100% by mass or less, more preferably 100% by mass in all surfactants in the liquid detergent composition for hard surfaces according to the present invention.

<Third Aspect>

The third aspect of the present invention is a liquid detergent composition for hard surfaces which contains component (a2); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of component (b2) is 50% by mass or more.

<Component (a2)>

Component (a2) in the present invention is an alkyl or alkenyl amine oxide in which the alkyl group or the alkenyl group has 14 or more and 18 or less carbons.

From the viewpoint of detergency, component (a2) is preferably an amine oxide having an alkyl group with 14 or more, and 18 or less, preferably 16 or less carbons, more preferably an amine oxide having an alkyl group with 14 carbons.

From the viewpoint of detergency, component (a2) is suitably a compound represented by general formula (a21) below:

[Formula 4]

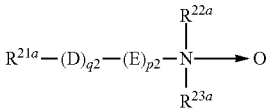

(a21)

wherein $R^{21a}$ represents an alkyl group having 14 or more and 18 or less carbons or an alkenyl group having 14 or more and 18 or less carbons, preferably an alkyl group having 14 or more and 18 or less carbons, $R^{22a}$ and $R^{23a}$ each independently represent an alkyl group having 1 or more and 3 or less carbons; D represents a —NHC(=O)— group or a —C(=O)NH— group, and E represents an alkylene group having 1 or more and 5 or less carbons; and q2 and p2 represent that q2=0 and p2=0 or q2=1 and p2=1.

From the viewpoint of detergency, $R^{21a}$ in general formula (a21) above is preferably an alkyl group having 14 or more and 18 or less carbons, more preferably an alkyl group having 14 or more and 16 or less carbons, further preferably an alkyl group having 14 carbons. From the viewpoint of detergency, each of $R^{22a}$ and $R^{23a}$ is preferably a methyl group having 1 carbon. From the viewpoint of detergency, q2 and p2 are preferably q2=0 and p2=0.

Preferred specific examples of component (a2) include (1) alkyl (14 or more and 18 or less carbons) dialkyl (1 or more and 3 or less carbons) amine oxides such as myristyl dimethylamine oxide, palmityl dimethylamine oxide and stearyl dimethylamine oxide; and (2) fatty acid (14 or more and 18 or less carbons) amidopropyl dialkyl (1 or more and 3 or less carbons) amine oxides such as myristic acid amidopropyl dimethylamine oxide, and from the viewpoint of detergency, (1) alkyl (14 or more and 18 or less carbons) dialkyl (1 or more and 3 or less carbons) amine oxides are more preferable.

The liquid detergent composition for hard surfaces according to the present invention contains component (a2) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more from the viewpoint of detergency, and preferably 20% by mass or less, more preferably 10% by mass or less, further preferably 8% by mass or less, furthermore preferably 6% by mass or less, furthermore preferably 5% by mass or less, furthermore preferably 4% by mass or less from the viewpoint of economic efficiency.

The liquid detergent composition for hard surfaces according to the present invention may contain amine oxides other than component (a2) within a range that does not impair the effects of the present invention.

From the viewpoint of detergency, the content of component (a2) is preferably 50% by mass or more, more preferably 70% by mass or more, further preferably 80% by mass or more, furthermore preferably 90% by mass or more, and preferably 100% by mass or less, more preferably 100% by mass in the alkyl or alkenyl amine oxide in which the alkyl group or the alkenyl group has 8 or more and 18 or less carbons in the liquid detergent composition for hard surfaces according to the present invention. Here, the alkyl or alkenyl amine oxide in which the alkyl group or the alkenyl group has 8 or more and 18 or less carbons preferably has the same structure except that $R^{21a}$ is an alkyl group or an alkenyl group having 8 or more and 18 or less carbons in general formula (a21) above.

<Component (b2)>

Component (b2) in the present invention is a monooxyethylene or polyoxyethylene alkyl or alkenyl amine in which the alkyl group or the alkenyl group has 8 or more and 14 or less carbons and the number of added moles of the oxyethylene group is 1 or more and 3 or less.

From the viewpoint of detergency, the number of carbons in the alkyl group or the alkenyl group in component (b2) is 8 or more, preferably 10 or more, more preferably 12 or more, and 14 or less, and among these groups, an alkyl group is preferable.

Examples of the alkyl group having 8 or more and 14 or less carbons or the alkenyl group having 8 or more and 14 or less carbons include an octyl group, a decyl group and a tetradecyl group, and these groups may be n-groups or iso-groups, and may be secondary alkyl groups or secondary alkenyl groups. Here, the secondary alkyl group or the secondary alkenyl group is an alkyl group or an alkenyl group in which the carbon atom bonded to the nitrogen atom of the amine is a tertiary carbon atom.

In component (b2), the number of added moles of the oxyethylene group is preferably 2 or more and 3 or less from the viewpoint of detergency.

In addition, an oxypropylene group may be added to component (b2) within a range that does not impair the effects of the present invention. For example, in component (b2), the number of added moles of the oxypropylene group is preferably 0.5 or less, and preferably 0 or more, more preferably 0.

From the viewpoint of detergency, component (b2) is suitably a compound represented by general formula (b21) below:

[Formula 5]

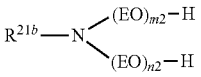

(b21)

wherein $R^{21b}$ is an alkyl group having 8 or more and 14 or less carbons or an alkenyl group having 8 or more and 14 or less carbons, EO is an oxyethylene group, each of m2 and n2 is the number of added moles, and independently a number of 0 or more and 3 or less, and m2+n2 is a number of 1 or more and 3 or less.

From the viewpoint of detergency, the number of carbons in $R^{21b}$ in general formula (b21) above is 8 or more, preferably 10 or more, more preferably 12 or more and 14 or less. From the viewpoint of detergency, $R^{21b}$ is an alkyl group or an alkenyl group, preferably an alkyl group. From the viewpoint of detergency, m2 and n2 are preferably numbers meeting the requirement that m2+n2 be a number of 2 or more and 3 or less.

The liquid detergent composition for hard surfaces according to the present invention contains component (b2) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more and furthermore preferably 0.8% by mass or more; and from the viewpoint of economic efficiency, preferably 20% by mass or less, more preferably 10% by mass or less, further preferably 8% by mass or less, furthermore preferably 6% by mass or less, furthermore preferably 5% by mass or less and furthermore preferably 4% by mass or less.

The liquid detergent composition for hard surfaces according to the present invention may contain polyoxyethylene alkyl or alkenyl amines other than component (b2) within a range that does not impair the effects of the present invention.

From the viewpoint of detergency, the content of component (b) is 50% by mass or more, preferably 60% by mass or more, more preferably 70% by mass or more, further preferably 80% by mass or more, and preferably 100% by mass or less in the monooxyethylene or polyoxyethylene alkyl or alkenyl amine in which the alkyl group or the alkenyl group has 8 or more and 24 or less carbons and the number of added moles of the oxyethylene group is 1 or more and 8 or less in the liquid detergent composition for hard surfaces according to the present invention.

From the viewpoint of detergency, the content of the monooxyethylene or polyoxyethylene alkyl or alkenyl amine in which the alkyl group or the alkenyl group has 12 or more and 14 or less carbons and the number of added moles of the oxyethylene group is 1 or more and 3 or less is preferably 50% by mass or more, more preferably 60% by mass or more, further preferably 70% by mass or more, furthermore preferably 80% by mass or more, and preferably 100% by mass or less in component (b2) in the liquid detergent composition for hard surfaces according to the present invention.

Further, from the viewpoint of detergency, the content of the monooxyethylene or polyoxyethylene alkyl or alkenyl amine in which the alkyl group or the alkenyl group has 12 or more and 14 or less carbons and the number of added moles of the oxyethylene group is 1 or more and 3 or less is 50% by mass or more, preferably 65% by mass or more, and preferably 100% by mass or less in the monooxyethylene or polyoxyethylene alkyl or alkenyl amine in which the alkyl group or the alkenyl group has 8 or more and 24 or less carbons and the number of added moles of the oxyethylene group is 1 or more and 8 or less in the liquid detergent composition for hard surfaces according to the present invention.

In the liquid detergent composition for hard surfaces according to the present invention, the mass ratio of the content of component (a2) to the content of component (b2), (a2)/(b2), is preferably 0.1 or more, more preferably 0.2 or more, further preferably 0.3 or more, furthermore preferably 0.5 or more, furthermore preferably 1 or more from the viewpoint of detergency, and preferably 20 or less, more preferably 15 or less, further preferably 12 or less, furthermore preferably 10 or less, furthermore preferably 9 or less, furthermore preferably 4 or less, furthermore preferably 3 or less from the same viewpoint.

In the liquid detergent composition for hard surfaces according to the present invention, the total content of the content of component (a2) and the content of component (b2) is preferably 0.02% by mass or more, more preferably 0.1% by mass or more, further preferably 0.5% by mass or more, furthermore preferably 1% by mass or more, furthermore preferably 2% by mass or more from the viewpoint of detergency, and preferably 40% by mass or less, more preferably 30% by mass or less, further preferably 20% by mass or less, furthermore preferably 10% by mass or less from the viewpoint of economic efficiency.

From the viewpoint of detergency, the total content of the content of component (a2) and the content of component (b2) is preferably 50% by mass or more, more preferably 60% by mass or more, further preferably 80% by mass or more, furthermore preferably 90% by mass or more, and preferably 100% by mass or less, more preferably 100% by mass in all surfactants in the liquid detergent composition for hard surfaces according to the present invention.

<Fourth Aspect>

The fourth aspect of the present invention is a liquid detergent composition for hard surfaces which is obtained by formulating component (A2), component (B2) and water.

From the viewpoint of detergency, the liquid detergent composition for hard surfaces according to the present invention is preferably obtained by formulating component (A2), component (B2) and water.

By the formulation described above, the liquid detergent composition for hard surfaces according to the third aspect, which contains component (a2), component (b2) and water, can be obtained.

<Component (A2)>

Component (A2) in the present invention is identical to component (a2) in the present invention. It is possible to use component (A2) in the present invention which has the aspect described for component (a2) in the present invention.

In the liquid detergent composition for hard surfaces according to the present invention, component (A2) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more from the viewpoint of detergency, and preferably 20% by mass or less, more preferably 10% by mass or less, further preferably 8% by mass or less, furthermore preferably 6% by mass or less, furthermore preferably 5% by mass or less, furthermore preferably 4% by mass or less from the viewpoint of economic efficiency.

<Component (B2)>

Component (B2) in the present invention is a monooxyethylene or polyoxyethylene alkyl or alkenyl amine in which the alkyl group or the alkenyl group has 8 or more and 14 or less carbons and the average number of added moles of the oxyethylene group is 1 or more and 3 or less. Component (B2) may contain component (b2). The liquid detergent composition for hard surfaces according to the present invention, which contains component (b2), may be obtained by formulating component (B2).

From the viewpoint of detergency, the number of carbons in the alkyl group or the alkenyl group in component (B2) is 8 or more, preferably 10 or more, more preferably 12 or more, and 14 or less, and among these groups, the alkyl group is preferable.

Examples of the alkyl group having 8 or more and 14 or less carbons or the alkenyl group having 8 or more and 14 or less carbons include an octyl group, a decyl group and a tetradecyl group, and these groups may be n-groups or iso-groups, and may be secondary alkyl groups or secondary alkenyl groups.

In component (B2), the average number of added moles of the oxyethylene group is preferably 1.5 or more and 2.5 or less from the viewpoint of detergency.

In addition, an oxypropylene group may be added to component (B2) within a range that does not impair the effects of the present invention. For example, in component (B2), the average number of added moles of the oxypropylene group is preferably 0.5 or less, and preferably 0 or more, more preferably 0.

From the viewpoint of detergency, component (B2) is suitably a compound represented by general formula (b22) below:

[Formula 6]

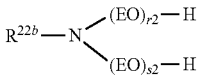

(b22)

wherein $R^{22b}$ is an alkyl group having 8 or more and 14 or less carbons or an alkenyl group having 8 or more and 14 or less carbons, EO is an oxyethylene group, each of r2 and s2 is the average number of added moles, and r2+s2 is a number of 1 or more and 3 or less.

From the viewpoint of detergency, the number of carbons in $R^{22b}$ in general formula (b22) above is 8 or more, preferably 10 or more, more preferably 12 or more and 14 or less. From the viewpoint of detergency, $R^{22b}$ is an alkyl group or an alkenyl group, preferably an alkyl group. From the viewpoint of detergency, r2 and s2 are preferably numbers meeting the requirement that r2+s2 be a number of 1.5 or more and 2.5 or less.

In the liquid detergent composition for hard surfaces according to the present invention, component (B2) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more and furthermore preferably 0.8% by mass or more; and from the viewpoint of economic efficiency, preferably 20% by mass or less, more preferably 10% by mass or less, further preferably 8% by mass or less, furthermore preferably 6% by mass or less, furthermore preferably 5% by mass or less and furthermore preferably 4% by mass or less.

In the liquid detergent composition for hard surfaces according to the present invention, the mass ratio of the formulation amount of component (A2) to the formulation amount of component (B2), (A2)/(B2), is preferably 0.1 or more, more preferably 0.2 or more, further preferably 0.3 or more, furthermore preferably 0.5 or more, furthermore preferably 1 or more from the viewpoint of detergency, and preferably 20 or less, more preferably 15 or less, further preferably 12 or less, furthermore preferably 10 or less, furthermore preferably 9 or less, furthermore preferably 5 or less, furthermore preferably 2.5 or less from the same viewpoint.

In the liquid detergent composition for hard surfaces according to the present invention, the total formulation amount of the formulation amount of component (A2) and the formulation amount of component (B2) is preferably 0.02% by mass or more, more preferably 0.1% by mass or more, further preferably 0.5% by mass or more, furthermore preferably 1% by mass or more, furthermore preferably 1.5% by mass or more, furthermore preferably 2.5% by mass or more from the viewpoint of detergency, and preferably 40% by mass or less, more preferably 30% by mass or less, further preferably 20% by mass or less, furthermore preferably 10% by mass or less from the viewpoint of economic efficiency.

From the viewpoint of detergency, the total formulation amount of the formulation amount of component (A2) and the formulation amount of component (B2) is preferably 50% by mass or more, more preferably 60% by mass or more, further preferably 80% by mass or more, furthermore preferably 90% by mass or more, and preferably 100% by mass or less, more preferably 100% by mass in all surfactants in the liquid detergent composition for hard surfaces according to the present invention.

Hereinafter, common matters of the first aspect, the second aspect, the third aspect and the fourth aspect of the present invention will be described.

<Component (c)>

In the liquid detergent composition for hard surfaces according to the present invention, a compound represented by general formula (c1) below may be contained or formulated as component (c) from the viewpoint of foaming properties:

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

From the viewpoint of foaming properties, the number of carbons in $R^{1c}$ in general formula (c1) is 1 or more and preferably 2 or more, and 8 or less, preferably 6 or less, more preferably 5 or less and further preferably 4 or less. From the viewpoint of foaming properties, $R^{1c}$ is a hydrocarbon group, preferably an alkyl group, an alkenyl group, an aryl group or an aralkyl group, more preferably an alkyl group, an aralkyl group or an aryl group, further preferably an alkyl group. From the viewpoint of foaming properties, $R^{2c}O$ is an alkyleneoxy group having 2 or more and 3 or less carbons, preferably an ethyleneoxy group or a propyleneoxy group. From the viewpoint of foaming properties, t is 1 or more, preferably 2 or more, and 3 or less.

Specific examples of component (c) include one or more kinds selected from 2-(2-n-butoxyethoxy)ethanol, 1-methoxy-2-propanol, dipropylene glycol monomethyl ether, 2-ethoxyethanol, 2-(2-ethoxyethoxy)ethanol, ethylene glycol monobutyl ether, triethylene glycol monobutyl ether, 1-butoxy-2-propanol, dipropylene glycol monobutyl ether, 2-isobutoxyethanol, 2-(2-isobutoxyethoxy)ethanol, 2-phenoxyethanol and ethylene glycol mono(2-ethylhexyl)ether. From the viewpoint of foaming properties, component (c) is preferably one or more kinds selected from dipropylene glycol monomethyl ether, ethylene glycol monobutyl ether, 2-(2-n-butoxyethoxy)ethanol, triethylene glycol monobutyl ether, 1-butoxy-2-propanol, dipropylene glycol monobutyl ether, 2-isobutoxyethanol, 2-(2-isobutoxyethoxy)ethanol and ethylene glycol mono(2-ethylhexyl)ether, more preferably one or more selected from dipropylene glycol monomethyl ether, ethylene glycol monobutyl ether, 2-(2-n-butoxyethoxy)ethanol, triethylene glycol monobutyl ether and 2-(2-isobutoxyethoxy)ethanol.

In the liquid detergent composition for hard surfaces according to the present invention, component (c) is contained or formulated in an amount of preferably 0.3% by mass or more, more preferably 0.5% by mass or more, further preferably 0.7% by mass or more, furthermore preferably 1% by mass or more from the viewpoint of foaming properties, and preferably 5% by mass or less, more preferably 4% by mass or less, further preferably 3% by mass or less, furthermore preferably 2% by mass or less from the viewpoint of cleaning properties.

<Other Components>

In addition to component (a1), component (b1) and optional component (c) in the first aspect of the present invention, component (A1), component (B1) and optional component (c) in the second aspect of the present invention, component (a2), component (b2) and optional component (c) in the third aspect of the present invention, and component (A1), component (B1) and optional component (c) in the fourth aspect of the present invention, other components such as contaminant redeposition preventing agents such as acrylic acid-maleic acid copolymers or salts thereof, methacrylic acid-maleic acid copolymers or salts thereof and diisobutylene-maleic acid copolymers or salts thereof; chelating agents such as EDTA, MGDA and citric acid; and solvents other than component (c), hydrotropic agents, dispersants, pH adjusters, thickeners, viscosity adjusters, perfumes, colorants, antioxidants, preservatives, bleaching agents and bleaching activators may be contained or formulated in the liquid detergent composition for hard surfaces according to the present invention in a range that does not impair the objects of the present invention.

The liquid detergent composition for hard surfaces according to the present invention contains water. That is, water is the balance after removal of component (a1), component (b1) and optional components in the first aspect of the present invention, or the balance after removal of component (A1), component (B1) and optional components in the second aspect of the present invention, or the balance after removal of component (a2), component (b2) and optional components in the third aspect of the present invention, or the balance after removal of component (A2), component (B2) and optional components in the fourth aspect of the present invention. In the liquid detergent composition for hard surfaces according to the present invention, water is contained or formulated in an amount of preferably 60% by mass or more, more preferably 70% by mass or more, further preferably 80% by mass or more, furthermore preferably 90% by mass or more from the viewpoint of handling properties, and preferably 99.9% by mass or less, more preferably 99.5% by mass or less, further preferably 99% by mass or less from the viewpoint of detergency. Preferably, ion-exchanged water, sterilized ion-exchanged water or the like is used.

The pH of the liquid detergent composition for hard surfaces according to the present invention at 25° C. is preferably in a neutral range. From the viewpoint of ease of handling, the pH is preferably 5 or more, more preferably 5.5 or more, further preferably 6 or more, and preferably 9 or less, more preferably 8.5 or less, further preferably 8 or less.

Preferably, the liquid detergent composition for hard surfaces according to the present invention is intended for a hard surface of a hard article, and moreover a hard surface of a food processing installation or a cooking installation.

The "food processing installation and/or cooking installation" means equipment and installations that are used in processing and/or cooking of foods in food processing plants. Examples of the equipment include food manufacturing or cooking equipment such as pipes, components, net conveyors, freezers, slicers and rice mill machines. Further, examples of the installations include floors, walls and workbenches.

Specifically, the liquid detergent composition for hard surfaces according to the present invention is preferably a detergent to be applied to a hard surface of a hard article, more preferably a detergent to be applied to a hard surface of a food processing installation or a cooking installation.

Further, specifically, the liquid detergent composition for hard surfaces according to the present invention is preferably a detergent to be sprayed to a hard surface of a hard article, more preferably a detergent to be sprayed to a hard surface of a food processing installation or a cooking installation.

Examples of the hard articles include food manufacturing equipment such as pipes and components, and hard articles in and around kitchens, the hard articles in and around kitchens are articles that are used in and around kitchens, and specific examples thereof include:

(1) facilities for storage of food, eating utensils and cooking utensils, such as refrigerators and cupboards;

(2) food cooking facilities such as drainage conduits, cooking tables, range hoods, sinks, burners and microwave ovens; and (3) floors and walls around the above facilities. In the present invention, the above-mentioned articles are referred to as "hard articles in and around kitchens" for the sake of convenience.

Further, examples of the materials of hard surfaces to be cleaned in the present invention, and moreover hard surfaces in and around kitchens, include plastics (including silicone resins), metals, ceramics, wood and combinations thereof.

<Method for Manufacturing Liquid Detergent Composition for Hard Surfaces>

The method for manufacturing the liquid detergent composition for hard surfaces according to the first aspect and the second aspect of the present invention is a method for manufacturing a liquid detergent composition for hard surfaces in which component (A1), component (B1) and water are mixed.

From the viewpoint of convenience, it is preferable to manufacture the liquid detergent composition for hard surfaces according to the first aspect of the present invention by the above-described manufacturing method.

Further, the method for manufacturing the liquid detergent composition for hard surfaces according to the third aspect and the fourth aspect of the present invention is a method for manufacturing a liquid detergent composition for hard surfaces in which component (A2), component (B2) and water are mixed.

From the viewpoint of convenience, it is preferable to manufacture the liquid detergent composition for hard surfaces according to the third aspect of the present invention by the above-described manufacturing method.

The matters described for the liquid detergent composition for hard surfaces according to the present invention may be appropriately applied to the method for manufacturing the liquid detergent composition for hard surfaces according to the present invention.

<Method for Cleaning Hard Surface>

The method for cleaning a hard surface according to the present invention is a method for cleaning a hard surface in which the liquid detergent composition for hard surfaces according to the first aspect of the present invention is contacted with a hard surface, the composition containing component (a1); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, the composition having a content of component (b1) of 50% by mass or more in the amine.

Further, the method for cleaning a hard surface according to the present invention is a method for cleaning a hard surface in which the liquid detergent composition for hard surfaces according to the second aspect of the present invention is contacted with a hard surface, the composition being obtained by formulating component (A1), component (B1) and water.

Further, the method for cleaning a hard surface according to the present invention is a method for cleaning a hard surface in which the liquid detergent composition for hard surfaces according to the third aspect of the present invention is contacted with a hard surface, the composition containing component (a2); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, the composition having a content of component (b2) of 50% by mass or more in the amine.

Further, the method for cleaning a hard surface according to the present invention is a method for cleaning a hard surface in which the liquid detergent composition for hard surfaces according to the fourth aspect of the present invention is contacted with a hard surface, the composition being obtained by formulating component (A2), component (B2) and water.

That is, in the method for cleaning a hard surface according to the present invention, the liquid detergent composition for hard surfaces according to the first aspect, the second aspect, the third aspect or the fourth aspect of the present invention is used. The preferred aspect of the composition is the same as that of the above-described liquid detergent composition for hard surfaces according to the present invention.

Hereinafter, common matters of the methods for cleaning a hard surface using the liquid detergent compositions for hard surfaces according to the first aspect, the second aspect, the third aspect or the fourth aspect of the present invention will be described.

The method for cleaning a hard surface according to the present invention can be suitably carried out as a method for cleaning a hard surface in which the liquid detergent composition for hard surfaces according to the present invention is contacted with a hard surface stained with oil spots including a degenerated oil, particularly a thermally degenerated oil. The method is a method for cleaning a hard surface in which the liquid detergent composition for hard surfaces according to the present invention is contacted with oil spots adhered to a hard surface and including a degenerated oil, particularly a thermally degenerated oil.

In the method for cleaning a hard surface according to the present invention, the liquid detergent composition for hard surfaces is contacted with a hard surface.

Specifically, preferably exemplified is a cleaning method in which the liquid detergent composition for hard surfaces is contacted with a hard surface as a stock solution, or the liquid detergent composition for hard surfaces is contacted with a hard surface as a stock solution without being diluted, that is, the liquid detergent composition for hard surfaces is contacted with a hard surface without being diluted. Further, exemplified is a cleaning method in which the liquid detergent composition for hard surfaces is contacted with a hard surface stained with oil spots including a degenerated oil, particularly a thermally degenerated oil, without being diluted.

However, a concentrated composition containing component (a1) and component (b1), component (A1) and component (B1), component (a2) and component (b2) or component (A2) and component (B2) in the present invention may be prepared, followed by diluting the concentrated composition with water to prepare the liquid detergent composition for hard surfaces according to the present invention, and contacting the composition with a hard surface. That is, a method for cleaning a hard surface may be employed in which a concentrated composition containing component (a1) and component (b1), component (A1) and component (B1), component (a2) and component (b2), or component (A2) and component (B2) in the present invention is diluted with water to prepare the liquid detergent composition for hard surfaces according to the present invention, and the liquid detergent composition for hard surfaces is contacted with a hard surface without being diluted.

Further, exemplified as the method for cleaning a hard surface according to the present invention is a cleaning method in which the liquid detergent composition for hard surfaces is contacted with a hard surface, and the hard surface is then left standing without exerting (applying) an external force such as a mechanical force. That is, exemplified is a cleaning method in which the composition is contacted with the hard surface without use of a flexible material such as a sponge, fingers or the like, and the hard surface is left standing without exerting an external force such as a mechanical force. This method is suitable for cleaning portions unreachable or details hardly reachable with hands or tools.

The phrase "left standing without exerting an external force such as a mechanical force" means that for example, intentional operation for cleaning is not carried out except for contact of the composition. For example, the phrase "left standing without exerting an external force such as a mechanical force" can be understood to include cases where the composition contacted with the hard surface naturally flows down along the hard surface and where vibrations that are not intended for cleaning propagate to the hard surface.

After being left standing, the hard surface is usually rinsed with water. At the time of rinsing the hard surface, an external force (physical force) may be exerted with a hand or the like, or the hard surface may be rinsed simply with a water flow.

In the method for cleaning a hard surface according to the present invention, the liquid detergent composition for hard surfaces is contacted with a hard surface as a target at a ratio in which the amount of the composition is preferably 0.1 g or more, more preferably 0.3 g or more, further preferably 0.4 g or more, and preferably 5 g or less, more preferably 3 g or less, further preferably 2 g or less per 100 $cm^2$ of the area of the hard surface. Further, it is preferable to apply or spray the composition.

In the method for cleaning a hard surface according to the present invention, the liquid detergent composition for hard surfaces is contacted with a hard surface, and the hard surface is then left standing for preferably 10 seconds or more, more preferably 20 seconds or more, further preferably 30 seconds or more, furthermore preferably 40 seconds or more from the viewpoint of enhancing detergency, and preferably 60 minutes or less, more preferably 30 minutes or less, further preferably 20 minutes or less, furthermore preferably 10 minutes or less, furthermore preferably 5 minutes or less from the same viewpoint. In this case, the hard surface may start being left standing at the point of first contacting the composition with the hard surface.

The temperature at the time of leaving the hard surface standing may be room temperature, and is, for example, 10° C. or higher and 30° C. or lower.

Further, in the method for cleaning a hard surface according to the present invention, the liquid detergent composition and a hard surface to be cleaned are kept in contact with each other for preferably 10 seconds or more, more preferably 20 seconds or more, further preferably 30 seconds or more, furthermore preferably 40 seconds or more from the viewpoint of enhancing detergency, and preferably 60 minutes or less, more preferably 30 minutes or less, further preferably 20 minutes or less, furthermore preferably 10 minutes or less, furthermore preferably 5 minutes or less from the same viewpoint.

In the method for cleaning a hard surface according to the present invention, a hard surface stained with oil spots and the like including a degenerated oil, particularly a thermally degenerated oil, may be immersed in the liquid detergent composition for hard surfaces to contact the composition with the hard surface, but from the viewpoint of efficiently enhancing detergency, a method is preferable in which the composition is sprayed or applied to contact the composition with a hard surface stained with oil spots and the like including a degenerated oil, particularly a thermally degenerated oil.

The method for contacting the liquid detergent composition for hard surfaces with a hard surface stained with oil spots and the like is preferably spraying or application, and a method is preferable in which the composition is sprayed in the form of liquid droplets or applied in the form of foam. Specifically, spray means is used. That is, it is preferable to use a detergent article for hard surfaces in which a container with a sprayer is filled with the liquid detergent composition for hard surfaces according to the present invention. The present invention provides a spray container-housed detergent article for hard surfaces in which a container with a sprayer is filled with the liquid detergent composition for hard surfaces according to the present invention.

Examples of the container with a sprayer, which is filled with the liquid detergent composition for hard surfaces according to the present invention, in the spray container-housed detergent article for hard surfaces according to the present invention, include manual spray devices which do not use a propellant, such as trigger-type spray containers and pump-type spray containers; and aerosols using a propellant. The container with a sprayer is preferably a trigger-type spray capable of spraying or applying contents in the form of liquid drops or foam, more preferably a trigger-type spray having a mechanism for spraying contents in the form of liquid droplets, or a trigger-type spray having a mechanism for forming foam (foam forming mechanism).

When a trigger-type spray having a mechanism for spraying the liquid detergent composition for hard surfaces according to the present invention in the form of liquid droplets is used in the spray container-housed detergent article for hard surfaces according to the present invention, the nozzle hole diameter of the spray nozzle of the spray container housing the composition is in the range of preferably 0.1 mm or more, more preferably 0.3 mm or more, and preferably 2 mm or less, more preferably 1 mm or less for ensuring that the composition is easily sprayed, liquid droplets are not coarsened, the composition is not linearly sprayed, and the area of the hard surface over which the composition can be sprayed is not extremely small.

When a trigger-type spray having a mechanism for spraying the composition in the form of liquid droplets is used, the spray container-housed detergent article for hard surfaces according to the present invention sprays the composition in an amount of preferably 0.1 mL or more, more preferably 0.3 mL or more, and preferably 5 mL or less, more preferably 2 mL or less in one operation.

When a trigger-type spray having a foam forming mechanism is used, the spray container-housed detergent article for hard surfaces according to the present invention sprays the composition in an amount of preferably 0.5 mL or more, more preferably 1 mL or more, and preferably 30 mL or less, more preferably 15 mL or less, further preferably 5 mL or less in one operation.

The method for cleaning a hard surface according to the present invention is preferable as a method for cleaning a hard surface of a hard article, and moreover a hard surface of a food processing installation and/or a cooking installation. Further, the method according to the present invention is preferable as a method for cleaning a hard surface of a hard article by hand, and moreover a method for cleaning a hard surface of a food processing installation and/or a cooking installation by hand.

The method for cleaning a hard surface according to the present invention is targeted at a hard surface of a hard article, preferably a hard surface of a food processing installation and/or a cooking installation.

Examples of the hard article, and the food processing installation and/or the cooking installation include those described above.

Examples of the materials of hard surfaces to be cleaned by the method for cleaning a hard surface according to the present invention include plastics (including silicone resins), metals, ceramics, wood and combinations thereof.

The method for cleaning a hard surface according to the present invention is capable of effectively cleaning oil spots adhered to the hard surfaces and including a degenerated oil, particularly a thermally degenerated oil.

In the method for cleaning a hard surface according to the present invention, the liquid detergent composition for hard surfaces according to the present invention is directly contacted with a hard surface. The hard surface may be left standing in a state of being in contact with the composition, and therefore operation of exerting a mechanical force as in scrubbing cleaning with a flexible material such as a sponge during cleaning is not necessary.

The method for cleaning a hard surface according to the present invention may include a step of rinsing a hard surface with water after contacting the liquid detergent composition for hard surfaces with the hard surface, preferably a step of rinsing a hard surface with water after leaving the hard surface standing after contacting the liquid detergent composition for hard surfaces with the hard surface.

With respect to the embodiments described above, the present invention further discloses the following liquid detergent compositions for hard surfaces, and the following methods for cleaning a hard surface. To these aspects, the matters described for the liquid detergent compositions for hard surfaces and the methods for cleaning a hard surface according to the present invention may be appropriately applied in a reciprocal manner.

<1x>

A liquid detergent composition for hard surfaces, containing: (a1) an alkyl or alkenyl amine oxide in which the alkyl group or the alkenyl group has 8 or more and 12 or less carbons (hereinafter referred to as component (a1)); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of (b1) a monooxyethylene or polyoxyethylene alkyl or alkenyl amine in which the alkyl group or the alkenyl group has 16 or more and 24 or less carbons and the number of added moles of the oxyethylene group is 1 or more and 3 or less (hereinafter referred to as component (b1)) is 50% by mass or more.

<2x>

The liquid detergent composition for hard surfaces according to <1x>, wherein component (a1) is an amine oxide having an alkyl group with 10 or more and 12 or less carbons, preferably an amine oxide having an alkyl group with 12 carbons.

<3x>

The liquid detergent composition for hard surfaces according to <1x>, wherein component (a1) is one or more kinds selected from alkyl (8 or more and 12 or less carbons) dialkyl (1 or more and 3 or less carbons) amine oxides; and fatty acid (8 or more and 12 or less carbons) amidopropyl dialkyl (1 or more and 3 or less carbons) amine oxides, preferably one or more kinds selected from alkyl (8 or more and 12 or less carbons) dialkyl (1 or more and 3 or less carbons) amine oxides.

<4x>

The liquid detergent composition for hard surfaces according to any one of <1x> to <3x>, wherein the liquid detergent composition for hard surfaces contains component (a1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<5x>

The liquid detergent composition for hard surfaces according to any one of <1x> to <4x>, wherein the content of component (a1) is preferably 50% by mass or more, more preferably 70% by mass or more, further preferably 80% by mass or more, furthermore preferably 90% by mass or more, and preferably 100% by mass or less in the alkyl or alkenyl amine oxide in which the alkyl group or the alkenyl group has 8 or more and 18 or less carbons.

<6x>

The liquid detergent composition for hard surfaces according to any one of <1x> to <4x>, wherein the content of component (a1) is 100% by mass in the alkyl or alkenyl amine oxide in which the alkyl group or the alkenyl group has 8 or more and 18 or less carbons.

<7x>

The liquid detergent composition for hard surfaces according to any one of <1x> to <6x>, wherein the number of carbons in the alkyl group or the alkenyl group, preferably the alkyl group, in component (b1) is preferably 22 or less, more preferably 20 or less, further preferably 18 or less.

<8x>

The liquid detergent composition for hard surfaces according to any one of <1x> to <7x>, wherein component (b1) is a compound represented by general formula (b11) below:

[Formula 7]

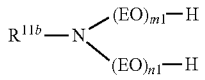

(b11)

wherein $R^{11b}$ is an alkyl group having 16 or more and 24 or less carbons or an alkenyl group having 16 or more and 24 or less carbons, EO is an oxyethylene group, each of m1 and n1 is the number of added moles, and independently a number of 0 or more and 3 or less, and m1+n1 is a number of 1 or more and 3 or less.

<9x>

The liquid detergent composition for hard surfaces according to <8x>, wherein the number of carbons in $R^{11b}$ is 16 or more, and 24 or less, preferably 20 or less, more preferably 18 or less.

<10x>

The liquid detergent composition for hard surfaces according to <8x> or <9x>, wherein Rub is an alkyl group.

<11x>

The liquid detergent composition for hard surfaces according to any one of <1x> to <10x>, wherein the liquid detergent composition for hard surfaces contains component (b1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<12x>

The liquid detergent composition for hard surfaces according to any one of <1x> to <11x>, wherein the content of component (b1) is preferably 60% by mass or more, more preferably 70% by mass or more, further preferably 80% by mass or more, furthermore preferably 90% by mass or more, and preferably 100% by mass or less in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

<13x>

The liquid detergent composition for hard surfaces according to any one of <1x> to <12x>, wherein the content of the monooxyethylene or polyoxyethylene alkyl or alkenyl amine in which the alkyl group or the alkenyl group has 16 or more and 18 or less carbons and the number of added moles of the oxyethylene group is 1 or more and 3 or less is preferably 50% by mass or more, more preferably 60% by mass or more, further preferably 70% by mass or more, furthermore preferably 80% by mass or more, furthermore preferably 90% by mass or more, and preferably 100% by mass or less in component (b1).

<14x>

The liquid detergent composition for hard surfaces according to any one of <1x> to <13x>, wherein the mass ratio of the content of component (a1) to the content of component (b1), (a1)/(b1), is preferably 0.1 or more, more preferably 0.2 or more, further preferably 0.3 or more, and preferably 20 or less, more preferably 15 or less, further preferably 12 or less, furthermore preferably 10 or less, furthermore preferably 8 or less, furthermore preferably 7 or less.

<15x>

The liquid detergent composition for hard surfaces according to any one of <1x> to <14x>, wherein the total content of the content of component (a1) and the content of component (b1) is preferably 0.02% by mass or more, more preferably 0.1% by mass or more, further preferably 0.5% by mass or more, furthermore preferably 1% by mass or more, furthermore preferably 1.5% by mass or more, furthermore preferably 2.5% by mass or more, and preferably 40% by mass or less, more preferably 30% by mass or less, further preferably 20% by mass or less, furthermore preferably 10% by mass or less.

<16x>

The liquid detergent composition for hard surfaces according to any one of <1x> to <15x>, wherein the total content of the content of component (a1) and the content of component (b1) is preferably 50% by mass or more, more preferably 60% by mass or more, further preferably 80% by mass or more, furthermore preferably 90% by mass or more, and preferably 100% by mass or less in all surfactants.

<17x>

A liquid detergent composition for hard surfaces which is obtained by formulating (A1) an alkyl or alkenyl amine oxide in which the alkyl group or the alkenyl group has 8 or more and 12 or less carbons (hereinafter referred to as component (A1)); (B1) a monooxyethylene or polyoxyethylene alkyl or alkenyl amine in which the alkyl group or the alkenyl group has 16 or more and 24 or less carbons and the average number of added moles of the oxyethylene group is 1 or more and 3 or less (hereinafter referred to as component (B1)); and water.

<18x>

The liquid detergent composition for hard surfaces according to <17x>, wherein component (A1) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<19x>

The liquid detergent composition for hard surfaces according to <17x> or <18x>, wherein the number of carbons in the alkyl group or the alkenyl group, preferably the alkyl group, in component (B1) is preferably 22 or less, more preferably 20 or less, further preferably 18 or less.

<20x>

The liquid detergent composition for hard surfaces according to any one of <17x> to <19x>, wherein component (B1) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<21x>

The liquid detergent composition for hard surfaces according to any one of <17x> to <20x>, wherein the mass ratio of the formulation amount of component (A1) to the formulation amount of component (B1), (A1)/(B1), is preferably 0.1 or more, more preferably 0.2 or more, further preferably 0.3 or more, and preferably 20 or less, more preferably 15 or less, further preferably 12 or less, furthermore preferably 10 or less, furthermore preferably 8 or less, furthermore preferably 7 or less.

<22x>

The liquid detergent composition for hard surfaces according to any one of <17x> to <21x>, wherein the total formulation amount of the formulation amount of component (A1) and the formulation amount of component (B1) is preferably 0.02% by mass or more, more preferably 0.1% by mass or more, further preferably 0.5% by mass or more, furthermore preferably 1% by mass or more, furthermore preferably 1.5% by mass or more, furthermore preferably 2.5% by mass or more, and preferably 40% by mass or less, more preferably 30% by mass or less, further preferably 20% by mass or less, furthermore preferably 10% by mass or less.

<23x>

The liquid detergent composition for hard surfaces according to any one of <17x> to <22x>, wherein the total formulation amount of the formulation amount of component (A1) and the formulation amount of component (B1) is preferably 50% by mass or more, more preferably 60% by mass or more, further preferably 80% by mass or more, furthermore preferably 90% by mass or more, and preferably 100% by mass or less in all surfactants.

<24x>

The liquid detergent composition for hard surfaces according to any one of <17x> to <22x>, wherein the total formulation amount of the formulation amount of component (A1) and the formulation amount of component (B1) is 100% by mass in all surfactants.

<25x>

The liquid detergent composition for hard surfaces according to any one of <1x> to <24x>, wherein a compound represented by general formula (c1) below is contained or formulated as component (c):

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

<26x>

The liquid detergent composition for hard surfaces according to <25x>, wherein component (c) is contained or formulated in an amount of preferably 0.3% by mass or more, more preferably 0.5% by mass or more, further preferably 0.7% by mass or more, furthermore preferably 1% by mass or more, and preferably 5% by mass or less, more preferably 4% by mass or less, further preferably 3% by mass or less, furthermore preferably 2% by mass or less.

<27x>

The liquid detergent composition for hard surfaces according to any one of <1x> to <26x>, wherein the liquid detergent composition for hard surfaces has a pH of 5 or more and 9 or less.

<28x>

The liquid detergent composition for hard surfaces according to any one of <1x> to <27x>, wherein the liquid detergent composition for hard surfaces is intended for a food processing installation or a cooking installation.

<29x>

A method for cleaning a hard surface in which oil spots adhered to a hard surface and including a degenerated oil are removed with the detergent composition according to any one of <1x> to <28x>.

<30x>

A method for cleaning a hard surface in which oil spots adhered to a hard surface and including a thermally degenerated oil are removed with the detergent composition according to any one of <1x> to <28x>.

<31x>

Use of the composition according to any one of <1x> to <28x> as a liquid detergent for hard surfaces.

<1y>

A liquid detergent composition for hard surfaces, containing: (a2) an alkyl or alkenyl amine oxide in which the alkyl group or the alkenyl group has 14 or more and 18 or less carbons (hereinafter referred to as component (a2)); a monooxyethylene or polyoxyethylene alkyl or alkenyl amine in which the alkyl group or the alkenyl group has 8 or more and 24 or less carbons and the number of added moles of the oxyethylene group is 1 or more and 8 or less; and water, wherein in the amine, the content of (b2) a monooxyethylene or polyoxyethylene alkyl or alkenyl amine in which the alkyl group or the alkenyl group has 8 or more and 14 or less carbons and the number of added moles of the oxyethylene group is 1 or more and 3 or less (hereinafter referred to as component (b2)) is 50% by mass or more.

<2y>

The liquid detergent composition for hard surfaces according to <1y>, wherein component (a2) is an amine oxide having an alkyl group with 14 or more and 18 or less, preferably an amine oxide having an alkyl group with 14 or more and 16 or less carbons, more preferably an amine oxide having an alkyl group with 14 carbons.

<3y>

The liquid detergent composition for hard surfaces according to <1y>, wherein component (a2) is one or more kinds selected from alkyl (14 or more and 18 or less carbons) dialkyl (1 or more and 3 or less carbons) amine oxides; and fatty acid (14 or more and 18 or less carbons) amidopropyl dialkyl (1 or more and 3 or less carbons) amine oxides, preferably one or more kinds selected from alkyl (14 or more and 18 or less carbons) dialkyl (1 or more and 3 or less carbons) amine oxides.

<4y>

The liquid detergent composition for hard surfaces according to any one of <1y> to <3y>, wherein the liquid detergent composition for hard surfaces contains component (a2) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<5y>

The liquid detergent composition for hard surfaces according to any one of <1y> to <4y>, wherein the content of component (a2) is preferably 50% by mass or more, more preferably 70% by mass or more, further preferably 80% by mass or more, furthermore preferably 90% by mass or more, and preferably 100% by mass or less in the alkyl or alkenyl amine oxide in which the alkyl group or the alkenyl group has 8 or more and 18 or less carbons.

<6y>

The liquid detergent composition for hard surfaces according to any one of <1y> to <4y>, wherein the content of component (a2) is 100% by mass in the alkyl or alkenyl amine oxide in which the alkyl group or the alkenyl group has 8 or more and 18 or less carbons.

<7y>

The liquid detergent composition for hard surfaces according to any one of <1y> to <6y>, wherein the number of carbons in the alkyl group or the alkenyl group, preferably the alkyl group, in component (b2) is 8 or more, preferably 10 or more, more preferably 12 or more, and 14 or less.

<8y>

The liquid detergent composition for hard surfaces according to any one of <1y> to <7y>, wherein component (b2) is a compound represented by general formula (b21) below:

[Formula 8]

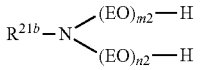

(b21)

wherein $R^{21b}$ is an alkyl group having 8 or more and 14 or less carbons or an alkenyl group having 8 or more and 14 or less carbons, EO is an oxyethylene group, each of m2 and n2 is the number of added moles, and independently a number of 0 or more and 3 or less, and m2+n2 is a number of 1 or more and 3 or less.

<9y>

The liquid detergent composition for hard surfaces according to <8y>, wherein the number of carbons in $R^{21b}$ is 8 or more, preferably 10 or more, more preferably 12 or more, and 14 or less.

<10y>

The liquid detergent composition for hard surfaces according to <8y> or <9y>, wherein $R^{21b}$ is an alkyl group.

<11y>

The liquid detergent composition for hard surfaces according to any one of <1y> to <10y>, wherein the liquid detergent composition for hard surfaces contains component (b2) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<12y>

The liquid detergent composition for hard surfaces according to any one of <1y> to <11y>, wherein the content of component (b2) is preferably 60% by mass or more, further preferably 70% by mass or more, furthermore preferably 80% by mass or more, and preferably 100% by mass or less in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

<13y>

The liquid detergent composition for hard surfaces according to any one of <1y> to <12y>, wherein the content of the monooxyethylene or polyoxyethylene alkyl or alkenyl amine in which the alkyl group or the alkenyl group has 12 or more and 14 or less carbons and the number of added moles of the oxyethylene group is 1 or more and 3 or less is preferably 50% by mass or more, more preferably 60% by mass or more, further preferably 70% by mass or more, furthermore preferably 80% by mass or more, and preferably 100% by mass or less in component (b2).

<14y>

The liquid detergent composition for hard surfaces according to any one of <1y> to <13y>, wherein the mass ratio of the content of component (a2) to the content of component (b2), (a2)/(b2), is preferably 0.1 or more, more preferably 0.2 or more, further preferably 0.3 or more, furthermore preferably 0.5 or more, furthermore preferably 1 or more, and preferably 20 or less, more preferably 15 or less, further preferably 12 or less, furthermore preferably 10 or less, furthermore preferably 9 or less, furthermore preferably 4 or less, furthermore preferably 3 or less.

<15y>

The liquid detergent composition for hard surfaces according to any one of <1y> to <14y>, wherein the total content of the content of component (a2) and the content of component (b2) is preferably 0.02% by mass or more, more preferably 0.1% by mass or more, further preferably 0.5% by mass or more, furthermore preferably 1% by mass or more, furthermore preferably 2% by mass or more, and preferably 40% by mass or less, more preferably 30% by mass or less, further preferably 20% by mass or less, furthermore preferably 10% by mass or less.

<16y>

The liquid detergent composition for hard surfaces according to any one of <1y> to <15y>, wherein the total content of the content of component (a2) and the content of component (b2) is preferably 50% by mass or more, more preferably 60% by mass or more, further preferably 80% by mass or more, furthermore preferably 90% by mass or more, and preferably 100% by mass or less in all surfactants.

<17y>

The liquid detergent composition for hard surfaces according to any one of <1y> to <15y>, wherein the total content of the content of component (a2) and the content of component (b2) is 100% by mass in all surfactants.

<18y>

A liquid detergent composition for hard surfaces which is obtained by formulating (A2) an alkyl or alkenyl amine oxide in which the alkyl group or the alkenyl group has 14 or more and 18 or less carbons (hereinafter referred to as component (A2)); (B2) a monooxyethylene or polyoxyethylene alkyl or alkenyl amine in which the alkyl group or the alkenyl group has 8 or more and 14 or less carbons and the average number of added moles of the oxyethylene group is 1 or more and 3 or less (hereinafter referred to as component (B2)); and water.

<19y>

The liquid detergent composition for hard surfaces according to <18y>, wherein component (A2) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<20Y>

The liquid detergent composition for hard surfaces according to <18y> or <19y>, wherein the number of carbons in the alkyl group or the alkenyl group, preferably the alkyl group, in component (B2) is preferably 10 or more, more preferably 12 or more.

<21y>

The liquid detergent composition for hard surfaces according to any one of <18y> to <20y>, wherein component (B2) is formulated in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, furthermore preferably 0.8% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less.

<22y>

The liquid detergent composition for hard surfaces according to any one of <18y> to <21y>, wherein the mass ratio of the formulation amount of component (A2) to the formulation amount of component (B2), (A2)/(B2), is preferably 0.1 or more, more preferably 0.2 or more, further preferably 0.3 or more, furthermore preferably 0.5 or more, furthermore preferably 1 or more, and preferably 20 or less, more preferably 15 or less, further preferably 12 or less, furthermore preferably 10 or less, furthermore preferably 9 or less, furthermore preferably 5 or less, furthermore preferably 2.5 or less.

<23y>

The liquid detergent composition for hard surfaces according to any one of <18y> to <22y>, wherein the total formulation amount of the formulation amount of component (A2) and the formulation amount of component (B2) is preferably 0.02% by mass or more, more preferably 0.1% by mass or more, further preferably 0.5% by mass or more, furthermore preferably 1% by mass or more, furthermore preferably 1.5% by mass or more, furthermore preferably 2.5% by mass or more, and preferably 40% by mass or less, more preferably 30% by mass or less, further preferably 20% by mass or less, furthermore preferably 10% by mass or less.

<24y>

The liquid detergent composition for hard surfaces according to any one of <18y> to <23y>, wherein the total formulation amount of the formulation amount of component (A2) and the formulation amount of component (B2) is preferably 50% by mass or more, more preferably 60% by mass or more, further preferably 80% by mass or more, furthermore preferably 90% by mass or more, and preferably 100% by mass or less in all surfactants.

<25y>

The liquid detergent composition for hard surfaces according to any one of <18y> to <23y>, wherein the total formulation amount of the formulation amount of component (A2) and the formulation amount of component (B2) is 100% by mass in all surfactants.

<26y>

The liquid detergent composition for hard surfaces according to any one of <1y> to <24y>, wherein a compound represented by general formula (c1) below is contained or formulated as component (c):

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

<27y>

The liquid detergent composition for hard surfaces according to <26y>, wherein component (c) is contained or formulated in an amount of preferably 0.3% by mass or more, more preferably 0.5% by mass or more, further preferably 0.7% by mass or more, furthermore preferably 1% by mass or more, and preferably 5% by mass or less, more preferably 4% by mass or less, further preferably 3% by mass or less, furthermore preferably 2% by mass or less.

<28y>

The liquid detergent composition for hard surfaces according to any one of <1y> to <27y>, wherein the liquid detergent composition for hard surfaces has a pH of 5 or more and 9 or less.

<29y>

The liquid detergent composition for hard surfaces according to any one of <1y> to <28y>, wherein the liquid detergent composition for hard surfaces is intended for a food processing installation or a cooking installation.

<30y>

A method for cleaning a hard surface in which oil spots adhered to a hard surface and including a degenerated oil are removed with the detergent composition according to any one of <1y> to <29y>.

<31y>

A method for cleaning a hard surface in which oil spots adhered to a hard surface and including a thermally degenerated oil are removed with the detergent composition according to any one of <1y> to <29y>.

<32y>

Use of the composition according to any one of <1y> to <29y> as a liquid detergent for hard surfaces.

EXAMPLES

Example 1 and Comparative Example 1

Liquid detergent compositions for hard surfaces as shown in Tables 1 and 2 were prepared using the following ingredients, and evaluated for the following items. The results are shown in Table 1. The liquid detergent compositions for hard surfaces in Tables 1 and 2 were prepared by a normal method. Specifically, component (A1), component (B1) or component (B1'), and component (c) were added to an appropriate amount of ion-exchanged water in such a manner as to obtain a formulation of each of the liquid detergent compositions for hard surfaces in Tables 1 and 2, the resulting mixture was warmed and dissolved at 60° C., and then brought back to room temperature (25° C.), and sodium hydroxide or/and hydrochloric acid was added to adjust the pH (25° C.) to 7. All of the ratios (% by mass) of the ingredients in Tables 1 and 2 were values based on effective contents.

<Ingredients>

Component (A1)

Lauryl dimethylamine oxide: AMPHITOL 20N (manufactured by Kao Corporation), compound of general formula (a11) in which $R^{11a}$ is a lauryl group, each of $R^{12a}$ and $R^{13a}$ is a methyl group, and q1=0 and p1=0.

Component (B1)

Polyoxyethylene (2.1) hardened tallow amine: AMIET 302 (manufactured by Kao Corporation), polyoxyethylene alkyl amine in which the alkyl group has 16 to 18 carbons and the average number of added moles of the oxyethylene group is 2.1, compound of general formula (b12) in which $R^{12a}$ is an alkyl group having 16 to 18 carbons, and r1+s1 is 2.1.

For component (B1), the above-described compound was pretreated with a trimethylsilylation agent, and the number of carbons in the alkyl group and the distribution of the number of added moles of the oxyethylene group were measured by a gas chromatography method under the conditions described below.

The content of component (b1) was almost 100% by mass in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

Further, the content of the monooxyethylene or polyoxyethylene alkyl or alkenyl amine in which the alkyl group or the alkenyl group has 16 or more and 18 or less carbons and the number of added moles of the oxyethylene group is 1 or more and 3 or less was also almost 100% by mass in component (b1).

Component (B1') (Comparative Component for Component (B1))

Polyoxyethylene (5) cocoalkyl amine: AMIET 105 (manufactured by Kao Corporation), polyoxyethylene alkyl amine in which the alkyl group has 8 to 18 carbons and the average number of added moles of the oxyethylene group is 5, compound of general formula (b12) in which $R^{12b}$ is an alkyl group having 8 to 18 carbons, and r1+s1 is 5.

Similarly for component (B1'), the compound was pretreated with a trimethylsilylation agent, and the number of carbons in the alkyl group and the distribution of the number of added moles of the oxyethylene group were measured by a gas chromatography method under the conditions described below. The results showed that the content of component (b1) was 7% by mass in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

Gas Chromatography Conditions

Gas chromatograph: Agilent Technologies 6850Network GC System

Column: Frontier LAB ULTRA UA-1HT

Temperature conditions: initial temperature 60° C. (2 min)

Temperature rising rate: 10° C./min (to 350° C.)

Final temperature: 350° C. (10 min)

Amount of sample: 1 μL

Inlet conditions: injection mode split method

Inlet temperature: 300° C.

Carrier gas: helium

Detector: FID

Component (c)

Compounds described in the tables were used.

[Evaluation of Detergency Against Thermally Degenerated Oil]

Rapeseed oil (manufactured by Wako Pure Chemical Industries Co., Ltd.) was heated in stationary state at 180° C. for 8 or 24 hours to prepare a thermally degenerated oil.

Each thermally degenerated oil was applied in an amount of about 1 mg/cm$^2$ to a test piece (manufactured by Engineering Test Service, SUS 304, 1 mm×25 mm×70 mm) weighed (x) beforehand using a four-decimal-place electronic balance, and the test piece was then weighed (y) using the four-decimal-place balance.

2 ml of each of the liquid detergent compositions for hard surfaces in Table 1 was sprayed in the form of foam to the coated test piece using a pump foamer (for Biore Hand Wash, manufactured by Kao Corporation), and the test piece was placed flat and left standing for 20 minutes. The test piece cleaned for 20 minutes was rinsed with tap water at 25° C. for 1 minute using a Leenerts tester (the amount of water was 700 ml and the rotation speed of the rotor was 300 rpm). After the rinsing, the test piece was dried in air overnight, and the mass of the cleaned test piece was weighed (z) with the four-decimal-place electronic balance.

The cleaning rate was determined from the equation below. The results of cleaning rates in the case of applying a thermally degenerated oil heated for 8 hours and cleaning rates in the case of applying a thermally degenerated oil heated for 24 hours are shown in Table 1.

$$\text{cleaning rate (\%)}=\{(y)-(z)\}/\{(y)-(x)\}\times 100$$

TABLE 1

| | | | | Examples | | | | | | | |
|---|---|---|---|---|---|---|---|---|---|---|---|
| | | | | 1-1 | 1-2 | 1-3 | 1-4 | 1-5 | 1-6 | 1-7 | 1-8 |
| Liquid detergent composition for hard surfaces | Formulation (% by mass) | (A1) | Lauryl dimethylamine oxide | 1 | 0.5 | 0.3 | 3 | 1.75 | 1.5 | 1.4 | 1.2 |
| | | (B1) | Polyoxyethylene (2.1) hardened tallow amine (average number of added moles: 2.1) | 1 | 0.5 | 0.3 | 3 | 0.25 | 0.5 | 0.6 | 0.8 |
| | | (B'1) | Polyoxyethylene (5) cocoalkyl amine (average number of added moles: 5) | | | | | | | | |
| | | | Water | Balance | Balance | Balance | Balance | Balance | Balance | Balance | Balance |
| | | | Total | 100 | 100 | 100 | 100 | 100 | 100 | 100 | 100 |
| | | | Content (% by mass) of component (a1) in composition | 1 | 0.5 | 0.3 | 3 | 1.75 | 1.5 | 1.4 | 1.2 |
| | | | Content (% by mass) of component (b1) in composition | 1 | 0.5 | 0.3 | 3 | 0.25 | 0.5 | 0.6 | 0.8 |
| | | | Content (% by mass) of component (a1) in amine oxide *1 | 100 | 100 | 100 | 100 | 100 | 100 | 100 | 100 |
| | | | Content (% by mass) of component (b1) in alkyl or alkenyl amine *2 | 100 | 100 | 100 | 100 | 100 | 100 | 100 | 100 |
| | | | pH (25° C.) | 7 | 7 | 7 | 7 | 7 | 7 | 7 | 7 |
| | | | (A1)/(B1) (mass ratio) | 1.0 | 1.0 | 1.0 | 1.0 | 7.0 | 3.0 | 2.3 | 1.5 |
| | | | ($_a$1)/(b1) (mass ratio) | 1.0 | 1.0 | 1.0 | 1.0 | 7.0 | 3.0 | 2.3 | 1.5 |
| Evaluation items | | | Cleaning rate against thermally degenerated oil (24 h) | 52.2 | 37.2 | 32.6 | 64.0 | — | — | 36.9 | 46.4 |
| | | | Cleaning rate against thermally degenerated oil (8 h) | 72.5 | — | — | — | 68.9 | 76.2 | — | — |

| | | | | Examples | | Comparative Examples | | | |
|---|---|---|---|---|---|---|---|---|---|
| | | | | 1-9 | 1-10 | 1-1 | 1-2 | 1-3 | 1-4 |
| Liquid detergent composition for hard surfaces | Formulation (% by mass) | (A1) | Lauryl dimethylamine oxide | 0.8 | 0.5 | 1 | | 2 | 1 |
| | | (B1) | Polyoxyethylene (2.1) hardened tallow amine (average number of added moles: 2.1) | 1.2 | 1.5 | | 1 | | |
| | | (B'1) | Polyoxyethylene (5) cocoalkyl amine (average number of added moles: 5) | | | | | | 1 |
| | | | Water | Balance | Balance | Balance | Balance | Balance | Balance |
| | | | Total | 100 | 100 | 100 | 100 | 100 | 100 |
| | | | Content (% by mass) of component (a1) in composition | 0.8 | 0.5 | 1 | | 2 | 1 |
| | | | Content (% by mass) of component (b1) in composition | 1.2 | 1.5 | | 1 | | 0.07 |
| | | | Content (% by mass) of component (a1) in amine oxide *1 | 100 | 100 | 100 | — | 100 | 100 |
| | | | Content (% by mass) of component (b1) in alkyl or alkenyl amine *2 | 100 | 100 | — | 100 | — | 7 |
| | | | pH (25° C.) | 7 | 7 | 7 | 7 | 7 | 7 |
| | | | (A1)/(B1) (mass ratio) | 0.7 | 0.3 | — | — | — | — |
| | | | ($_a$1)/(b1) (mass ratio) | 0.7 | 0.3 | — | — | — | 14.3 |

TABLE 1-continued

| | | | | | | | | |
|---|---|---|---|---|---|---|---|---|
| | Evaluation items | Cleaning rate against thermally degenerated oil (24 h) | 31.7 | — | 22 | 0.5 | 23.3 | 13.7 |
| | | Cleaning rate against thermally degenerated oil (8 h) | — | 78.2 | — | — | 40 | — |

*1: The content (% by mass) of component (a1) in the amine oxide indicates the content (% by mass) of component (a1) in the alkyl or alkenyl amine oxide in which the alkyl group or the alkenyl group has 8 or more and 18 or less carbons.
*2: The content (% by mass) of component (b1) in the alkyl or alkenyl amine indicates the content (% by mass) of component (b1) in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

[Evaluation of Foaming Properties]

5 ml of each of the liquid detergent compositions for hard surfaces in Table 2 was sprayed in the form of foam to a vertical surface of a longitudinally placed rectangular stainless steel tray (manufactured by AS ONE Corporation, 199 mm×140 mm×18 mm) using a spray for business use (refillable spray container for business use, manufactured by Kao Corporation) (the trigger of the spray was squeezed five times). Foam quality immediately after the spraying was visually observed, and the foaming properties were evaluated according to the following assessment criteria. The results are shown in Table 2.

Assessment Criteria

Score 0: foaming did not occur.

Score 1: foaming occurred, and foam adhered to the vertical surface did not remain.

Score 2: foaming occurred, and part of foam adhered to the vertical surface remained.

Score 3: foaming occurred, and the entirety of foam adhered to the vertical surface remained.

Example 2 and Comparative Example 2

Liquid detergent compositions for hard surfaces as shown in Tables 3 and 4 were prepared using the following ingredients, and evaluated for the following items. The results are shown in Tables 3 and 4. The liquid detergent compositions for hard surfaces in Tables 3 and 4 were prepared by a normal method. Specifically, component (A2), component (B2) or component (B2'), and component (c) were added to an appropriate amount of ion-exchanged water in such a manner as to obtain a formulation of each of the liquid detergent compositions for hard surfaces in Tables 3 and 4, the resulting mixture was warmed and dissolved at 60° C., and then brought back to room temperature (25° C.), and sodium hydroxide or/and hydrochloric acid was added to adjust the pH (25° C.) to 7. All of the ratios (% by mass) of the ingredients in Tables 3 and 4 were values based on effective contents.

TABLE 2

| | | | | Examples | | | | | | | | | | | |
|---|---|---|---|---|---|---|---|---|---|---|---|---|---|---|---|
| | | | | 1-11 | 1-12 | 1-13 | 1-14 | 1-15 | 1-16 | 1-17 | 1-18 | 1-19 | 1-20 | 1-21 | 1-22 |
| Liquid detergent composition for hard surfaces | Formulation (% by mass) | (A1) | Lauryl dimethylamine oxide | 1 | 1 | 1 | 1 | 1 | 1 | 1 | 1 | 1 | 1 | 1 | 1 |
| | | (B1) | Polyoxyethylene (2.1) hardened tallow amine (average number of added moles: 2.1) | 1 | 1 | 1 | 1 | 1 | 1 | 1 | 1 | 1 | 1 | 1 | 1 |
| | | (c) | Dipropylene glycol monomethyl ether | | 0.5 | | | | | | | | | | |
| | | | 2-Ethoxyethanol | | | 0.5 | | | | | | | | | |
| | | | 2-(2-Ethoxy-ethoxy)ethanol | | | | 0.5 | | | | | | | | |
| | | | Ethylene glycol monobutyl ether | | | | | 0.5 | | | | | | | |
| | | | 2-(2-n-butoxy-ethoxy)ethanol | | | | | | 0.5 | | | | | | |
| | | | Triethylene glycol monobutyl ether | | | | | | | 0.5 | | | | | |
| | | | 1-Butoxy-2-propanol | | | | | | | | 0.5 | | | | |
| | | | Dipropylene glycol monobutyl ether | | | | | | | | | 0.5 | | | |
| | | | 2-Isobutoxyethanol | | | | | | | | | | 0.5 | | |
| | | | 2-(2-Isobutoxy-ethoxy)ethanol | | | | | | | | | | | 0.5 | |
| | | | 2-Phenoxyethanol | | | | | | | | | | | | 0.5 |
| | | | Water | Bal-ance | Bal-ance | Bal-ance | Bal-ance | Bal-ance | Bal-ance | Bal-ance | Bal-ance | Bal-ance | Bal-ance | Bal-ance | Bal-ance |
| | | | Total | 100 | 100 | 100 | 100 | 100 | 100 | 100 | 100 | 100 | 100 | 100 | 100 |
| | | | Content (% by mass) of component (a1) in composition | 1 | 1 | 1 | 1 | 1 | 1 | 1 | 1 | 1 | 1 | 1 | 1 |
| | | | Content (% by mass) of component (b1) in composition | 1 | 1 | 1 | 1 | 1 | 1 | 1 | 1 | 1 | 1 | 1 | 1 |
| | | | pH(25° C.) | 7 | 7 | 7 | 7 | 7 | 7 | 7 | 7 | 7 | 7 | 7 | 7 |
| Evaluation items | | | Foaming properties (score) | 0 | 3 | 2 | 2 | 3 | 3 | 3 | 3 | 3 | 3 | 3 | 2 |

<Ingredients>

Component (A2)

Myristyl dimethylamine oxide: AMPHITOL 40N (manufactured by Kao Corporation), compound of general formula (a21) in which $R^{21a}$ is a myristyl group, each of $R^{22a}$ and $R^{23a}$ is a methyl group, and q2=0 and p2=0.

Component (B2)

Polyoxyethylene (2.1) cocoalkyl amine: AMIET 102 (manufactured by Kao Corporation), polyoxyethylene alkyl amine in which the alkyl group has 8 to 18 carbons and the average number of added moles of the oxyethylene group is 2.1, compound of general formula (b22) in which $R^{22a}$ is an alkyl group having 8 to 18 carbons, and r2+s2 is 2.1.

For component (B2), the above-described compound was pretreated with a trimethylsilylation agent, and the number of carbons in the alkyl group and the distribution of the number of added moles of an oxyethylene group were measured by a gas chromatography method under the conditions described below.

The content of component (b2) was 85% by mass in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

Further, the content of the monooxyethylene or polyoxyethylene alkyl or alkenyl amine in which the alkyl group or the alkenyl group has 12 or more and 14 or less carbons and the number of added moles of the oxyethylene group is 1 or more and 3 or less was 85% by mass in component (b2).

Component (B2') (Comparative Component for Component (B2))

Polyoxyethylene (2.1) hardened tallow amine: AMIET 302 (manufactured by Kao Corporation), polyoxyethylene alkyl amine in which the alkyl group has 16 to 18 carbons and the average number of added moles of the oxyethylene group is 2.1, compound of general formula (b22) in which $R^{22a}$ is an alkyl group having 16 to 18 carbons, and r2+s2 is 2.1.

Similarly for component (B2'), the compound was pretreated with a trimethylsilylation agent, and the number of carbons in the alkyl group and the distribution of the number of added moles of the oxyethylene group were measured by a gas chromatography method under the conditions described below. The results showed that the content of component (b2) was 0% by mass in the compound.

Gas Chromatography Conditions

Gas chromatograph: Agilent Technologies 6850Network GC System

Column: Frontier LAB ULTRA UA-1HT

Temperature conditions: initial temperature 60° C. (2 min)

Temperature rising rate: 10° C./min (to 350° C.)

Final temperature: 350° C. (10 min)

Amount of sample: 1 μL

Inlet conditions: injection mode split method

Inlet temperature: 300° C.

Carrier gas: helium

Detector: FID

Component (c)

Compounds described in the tables were used.

[Evaluation of Detergency Against Thermally Degenerated Oil]

Rapeseed oil (manufactured by Wako Pure Chemical Industries Co., Ltd.) was heated in stationary state at 180° C. for 8 or 24 hours to prepare a thermally degenerated oil. Each thermally degenerated oil was applied in an amount of about 1 mg/cm$^2$ to a test piece (manufactured by Engineering Test Service, SUS 304, 1 mm×25 mm×70 mm) weighed (x) beforehand using a four-decimal-place electronic balance, and the test piece was then weighed (y) using the four-decimal-place balance.

2 ml of each of the liquid detergent compositions for hard surfaces was sprayed in the form of foam to each coated test piece using a pump foamer (for Biore Hand Wash, manufactured by Kao Corporation), and the test piece was placed flat and left standing for 20 minutes. The test piece cleaned for 20 minutes was rinsed with tap water at 25° C. for 1 minute using a Leenerts tester (the amount of water was 700 ml and the rotation speed of the rotor was 300 rpm). After the rinsing, the test piece was dried in air overnight, and the mass of the cleaned test piece was weighed (z) with the four-decimal-place electronic balance.

The cleaning rate was determined from the equation below. The results of cleaning rates in the case of applying a thermally degenerated oil heated for 8 hours and cleaning rates in the case of applying a thermally degenerated oil heated for 24 hours are shown in Table 3.

$$\text{cleaning rate (\%)}=\{(y)-(z)\}/\{(y)-(x)\}\times 100$$

TABLE 3

| | | | | Examples | | | | | | | Comparative Examples | | | |
|---|---|---|---|---|---|---|---|---|---|---|---|---|---|---|
| | | | | 2-1 | 2-2 | 2-3 | 2-4 | 2-5 | 2-6 | 2-7 | 2-1 | 2-2 | 2-3 | 2-4 |
| Liquid detergent composition for hard surfaces | Formulation (% by mass) | (A2) | Myristyl dimethylamine oxide | 1 | 0.5 | 3 | 1.75 | 1.5 | 1.4 | 1.2 | 1 | | 2 | 1 |
| | | (B2) | Polyoxyethylene (2.1) cocoalkyl amine (average number of added moles: 2.1) | 1 | 0.5 | 3 | 0.25 | 0.5 | 0.6 | 0.8 | | 1 | | |
| | | (B2') | Polyoxyethylene (2.1) hardened tallow amine (average number of added moles: 2.1) | | | | | | | | | | | 1 |
| | | | Water | Balance | Balance | Balance | Balance | Balance | Balance | Balance | Balance | Balance | Balance | Balance |
| | | | Total | 100 | 100 | 100 | 100 | 100 | 100 | 100 | 100 | 100 | 100 | 100 |
| | Content (% by mass) of component (a2) in composition | | | 1 | 0.5 | 3 | 1.75 | 1.5 | 1.4 | 1.2 | 1 | | 2 | 1 |

TABLE 3-continued

| | | Examples | | | | | | | Comparative Examples | | | |
|---|---|---|---|---|---|---|---|---|---|---|---|---|
| | | 2-1 | 2-2 | 2-3 | 2-4 | 2-5 | 2-6 | 2-7 | 2-1 | 2-2 | 2-3 | 2-4 |
| | Content (% by mass) of component (b2) in composition | 0.85 | 0.43 | 2.55 | 0.21 | 0.43 | 0.51 | 0.68 | | 0.85 | | |
| | Content (% by mass) of component (a2) in amine oxide *3 | 100 | 100 | 100 | 100 | 100 | 100 | 100 | 100 | — | 100 | 100 |
| | Content (% by mass) of component (b2) in alkyl or alkenyl amine *4 | 85 | 85 | 85 | 85 | 85 | 85 | 85 | — | 85 | — | 0 |
| | pH(25° C.) | 7 | 7 | 7 | 7 | 7 | 7 | 7 | 7 | 7 | 7 | 7 |
| | (A2)/(B2) (mass ratio) | 1.0 | 1.0 | 1.0 | 7.0 | 3.0 | 2.3 | 1.5 | — | — | — | — |
| | ($_a$2)/(b2) (mass ratio) | 1.2 | 1.2 | 1.2 | 8.2 | 3.5 | 2.7 | 1.8 | — | — | — | — |
| Evaluation items | Cleaning rate against thermally degenerated oil (24 h) | 60.2 | 49.0 | 75.0 | — | — | 75.6 | 66.7 | 45.9 | 0 | 48.7 | 6.5 |
| | Cleaning rate against thermally degenerated oil (8 h) | — | 82.6 | — | 96.6 | 96.6 | — | — | — | — | 75.3 | — |

*3: The content (% by mass) of component (a2) in the amine oxide indicates the content (% by mass) of component (a2) in the alkyl or alkenyl amine oxide in which the alkyl group or the alkenyl group has 8 or more and 18 or less carbons.
*4: The content (% by mass) of component (b2) in the alkyl or alkenyl amine indicates the content (% by mass) of component (b2) in the monooxyethylene or polyoxyethylene alkyl or alkenyl amine in which the alkyl group or the alkenyl group has 8 or more and 24 or less carbons and the number of added moles of the oxyethylene group is 1 or more and 8 or less.

[Evaluation of Foaming Properties]

5 ml of each of the liquid detergent compositions for hard surfaces in Table 4 was sprayed in the form of foam to a vertical surface of a longitudinally placed rectangular stainless steel tray (manufactured by AS ONE Corporation, 199 mm×140 mm×18 mm) using a spray for business use (refillable spray container for business use, manufactured by Kao Corporation) (the trigger of the spray was squeezed five times). Foam quality immediately after the spraying was visually observed, and the foaming properties were evaluated according to the following assessment criteria. The results are shown in Table 4.

Assessment Criteria

Score 0: foaming did not occur.

Score 1: foaming occurred, and foam adhered to the vertical surface did not remain.

Score 2: foaming occurred, and part of foam adhered to the vertical surface remained.

Score 3: foaming occurred, and the entirety of foam adhered to the vertical surface remained.

TABLE 4

| | | | | Examples | | | | | | | | |
|---|---|---|---|---|---|---|---|---|---|---|---|---|
| | | | | 2-8 | 2-9 | 2-10 | 2-11 | 2-12 | 2-13 | 2-14 | 2-15 | 2-16 |
| Liquid detergent composition for hard surfaces | Formulation (% by mass) | (A2) | Myristyl dimethylamine oxide | 1 | 1 | 1 | 1 | 1 | 1 | 1 | 1 | 1 |
| | | (B2) | Polyoxyethylene (2.1) cocoalkyl amine (average number of added moles: 2.1) | 1 | 1 | 1 | 1 | 1 | 1 | 1 | 1 | 1 |
| | | (c) | Ethylene glycol monobutyl ether | | 1.5 | | | | | | | |
| | | | 2-(2-Ethoxyethoxy)ethanol | | | 1.5 | | | | | | |
| | | | Triethylene glycol monobutyl ether | | | | 1.5 | | | | | |
| | | | 1-Butoxy-2-propanol | | | | | 1.5 | | | | |
| | | | Dipropylene glycol monobutyl ether | | | | | | 1.5 | | | |
| | | | 2-Isobutoxyethanol | | | | | | | 1.5 | | |
| | | | 2-(2-Isobutoxy-ethoxy)ethanol | | | | | | | | 1.5 | |
| | | | Ethylene glycol mono(2-ethylhexyl)ether | | | | | | | | | 1.5 |
| | | | Water | Balance | Balance | Balance | Balance | Balance | Balance | Balance | Balance | Balance |
| | | | Total | 100 | 100 | 100 | 100 | 100 | 100 | 100 | 100 | 100 |
| | | | Content (% by mass) of component (a2) in composition | 1 | 1 | 1 | 1 | 1 | 1 | 1 | 1 | 1 |
| | | | Content (% by mass) of component (b2) in composition | 0.85 | 0.85 | 0.85 | 0.85 | 0.85 | 0.85 | 0.85 | 0.85 | 0.85 |
| | | | pH(25° C.) | 7 | 7 | 7 | 7 | 7 | 7 | 7 | 7 | 7 |
| Evaluation items | | | Foaming properties (score) | 0 | 3 | 3 | 3 | 3 | 3 | 3 | 3 | 3 |

The invention claimed is:

1. A liquid detergent composition for hard surfaces, comprising the following component (a1), the following component (b1), the following component (c), and water:

component (a1): a compound represented by the following general formula (a11):

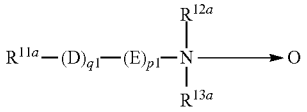

(a11)

wherein $R^{11a}$ represents an alkyl group having 8 or more and 12 or less carbons or an alkenyl group having 8 or more and 12 or less carbons, $R^{12a}$ and $R^{13a}$ each independently represent an alkyl group having 1 or more and 3 or less carbons; D represents a —NHC(=O)— group or a —C(=O)NH— group, and E represents an alkylene group having 1 or more and 5 or less carbons; and q1 and p1 represent that q1=0 and p1=0 or q1=1 and p1=1; and component (b1): a compound represented by the following general formula (b11):

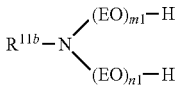

(b11)

wherein $R^{11b}$ is an alkyl group having 16 or more and 24 or less carbons or an alkenyl group having 16 or more and 24 or less carbons, EO is an oxyethylene group, each of m1 and n1 is the number of added moles, and independently a number of 0 or more and 3 or less, and m1+n1 is a number of 1 or more and 3 or less, wherein component (b1) is present in a monooxyethylene or polyoxyethylene alkyl or alkenyl amine, in which the alkyl group or the alkenyl group has 8 or more and 24 or less carbons and the number of added moles of the oxyethylene group is 1 or more and 8 or less, in an amount of 50% by mass or more of the amine, wherein the component (c) is one or more kinds selected from 2-(2-n-butoxyethoxy)ethanol, 1-methoxy-2-propanol, dipropylene glycol monomethyl ether, 2-ethoxyethanol, 2-(2-ethoxyethoxy)ethanol, ethylene glycol monobutyl ether, triethylene glycol monobutyl ether, 1-butoxy-2-propanol, dipropylene glycol monobutyl ether, 2-isobutoxyethanol, 2-(2-isobutoxyethoxy)ethanol, 2-phenoxyethanol and ethylene glycol mono(2-ethylhexyl)ether, and wherein a mass ratio of the content of the component (a1) to the content of the component (b1), (a1)/(b1), is 0.1 or more and 20 or less.

2. The liquid detergent composition for hard surfaces according to claim 1, wherein the component (a1) is present in an alkyl or alkenyl amine oxide, in which the alkyl group or the alkenyl group has 8 or more and 18 or less carbons, in an amount of 50% by mass or more of the oxide.

3. The liquid detergent composition for hard surfaces according to claim 1, wherein in the composition, the content of the component (a1) is 0.01% by mass or more and 20% by mass or less, and the content of the component (b1) is 0.01% by mass or more and 20% by mass or less.

4. The liquid detergent composition for hard surfaces according to claim 1, wherein the liquid detergent composition for hard surfaces has a pH of 5 or more and 9 or less.

5. The liquid detergent composition for hard surfaces according to claim 1, wherein the liquid detergent composition for hard surfaces is intended for a food processing installation or a cooking installation.

6. A method for cleaning a hard surface in which oil spots adhered to the hard surface and including a degenerated oil are removed with the detergent composition according to claim 1.

7. A liquid detergent composition for hard surfaces which is obtained by formulating (A1) an alkyl or alkenyl amine oxide in which the alkyl group or the alkenyl group has 8 or more and 12 or less carbons (hereinafter referred to as a component (A1)); (B1) a monooxyethylene or polyoxyethylene alkyl or alkenyl amine in which the alkyl group or the alkenyl group has 16 or more and 24 or less carbons and the average number of added moles of the oxyethylene group is 1 or more and 3 or less (hereinafter referred to as a component (B1)); a component (c); and water, wherein the component (c) is one or more kinds selected from 2-(2-n-butoxyethoxy)ethanol, 1-methoxy-2-propanol, dipropylene glycol monomethyl ether, 2-ethoxyethanol, 2-(2-ethoxyethoxy)ethanol, ethylene glycol monobutyl ether, triethylene glycol monobutyl ether, 1-butoxy-2-propanol, dipropylene glycol monobutyl ether, 2-isobutoxyethanol, 2-(2-isobutoxyethoxy)ethanol, 2-phenoxyethanol and ethylene glycol mono(2-ethylhexyl)ether, and wherein a mass ratio of the formulation amount of the component (A1) to the formulation amount of the component (B1), (A1)/(B1), is 0.1 or more and 20 or less.

8. A liquid detergent composition for hard surfaces, comprising the following component (a2), the following component (b2), the following component (c), and water:

component (a2): a compound represented by the following general formula (a21):

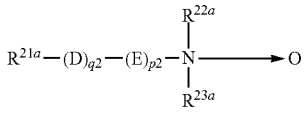

(a21)

wherein $R^{21a}$ represents an alkyl group having 14 or more and 18 or less carbons or an alkenyl group having 14 or more and 18 or less carbons, $R^{22a}$ and $R^{23a}$ each independently represent an alkyl group having 1 or more and 3 or less carbons; D represents a —NHC(=O)— group or a —C(=O)NH— group, and E represents an alkylene group having 1 or more and 5 or less carbons; and q2 and p2 represent that q2=0 and p2=0 or q2=1 and p2=1; and component (b2): a compound represented by the following general formula (b21):

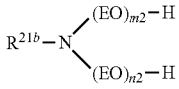

(b21)

wherein $R^{21b}$ is an alkyl group having 8 or more and 14 or less carbons or an alkenyl group having 8 or more and 14 or less carbons, EO is an oxyethylene group, each of m2 and n2 is the number of added moles, and independently a number of 0 or more and 3 or less, and m2+n2 is a number of 1 or more and 3 or less, wherein component (b2) is present in a monooxyethylene or polyoxyethylene alkyl or alkenyl amine, in which the alkyl group or the alkenyl group has 8 or more and 24 or less carbons and the number of added moles of the oxyethylene group is 1 or more and 8 or less, in an amount of 50% by mass or more of the amine, wherein the component (c) is one or more kinds selected from 2-(2-n-butoxyethoxy)ethanol, 1-methoxy-2-propanol, dipropylene glycol monomethyl ether, 2-ethoxyethanol, 2-(2-ethoxyethoxy)ethanol, ethylene glycol monobutyl ether, triethylene glycol monobutyl ether, 1-butoxy-2-propanol, dipropylene glycol monobutyl ether, 2-isobutoxyethanol, 2-(2-isobutoxyethoxy)ethanol, 2-phenoxyethanol and ethylene glycol mono(2-ethylhexyl)ether, and wherein a mass ratio of the content of the component (a2) to the content of the component (b2), (a2)/(b2), is 0.1 or more and 20 or less.

9. The liquid detergent composition for hard surfaces according to claim 8, wherein the component (a2) is present in an alkyl or alkenyl amine oxide, in which the alkyl group or the alkenyl group has 8 or more and 18 or less carbons, in an amount of 50% by mass or more of the oxide.

10. The liquid detergent composition for hard surfaces according to claim 8, wherein in the composition, the content of the component (a2) is 0.01% by mass or more and 20% by mass or less, and the content of the component (b2) is 0.01% by mass or more and 20% by mass or less.

11. A liquid detergent composition for hard surfaces which is obtained by formulating (A2) an alkyl or alkenyl amine oxide in which the alkyl group or the alkenyl group has 14 or more and 18 or less carbons (hereinafter referred to as a component (A2)); (B2) a monooxyethylene or polyoxyethylene alkyl or alkenyl amine in which the alkyl group or the alkenyl group has 8 or more and 14 or less carbons and the average number of added moles of the oxyethylene group is 1 or more and 3 or less (hereinafter referred to as a component (B2)); a component (c); and water, wherein the component (c) is one or more kinds selected from 2-(2-n-butoxyethoxy)ethanol, 1-methoxy-2-propanol, dipropylene glycol monomethyl ether, 2-ethoxyethanol, 2-(2-ethoxyethoxy)ethanol, ethylene glycol monobutyl ether, triethylene glycol monobutyl ether, 1-butoxy-2-propanol, dipropylene glycol monobutyl ether, 2-isobutoxyethanol, 2-(2-isobutoxyethoxy)ethanol, 2-phenoxyethanol and ethylene glycol mono(2-ethylhexyl)ether, and wherein a mass ratio of the formulation amount of the component (A2) to the formulation amount of the component (B2), (A2)/(B2), is 0.1 or more and 20 or less.

* * * * *